US008811846B2

(12) United States Patent
Yoshida et al.

(10) Patent No.: US 8,811,846 B2
(45) Date of Patent: Aug. 19, 2014

(54) OPTICAL SENSOR WITH POSITIONING REFERENCE SURFACE AND IMAGE FORMING APPARATUS INCORPORATING OPTICAL SENSOR

(75) Inventors: Akira Yoshida, Kanagawa-ken (JP); Hitoshi Ishibashi, Kanagawa-ken (JP); Yoshiaki Miyashita, Tokyo-to (JP); Kohta Fujimori, Kanagawa-ken (JP); Nobutaka Takeuchi, Kanagawa-ken (JP); Kayoko Tanaka, Tokyo-to (JP)

(73) Assignee: Ricoh Company, Ltd., Toyko (JP)

( * ) Notice: Subject to any disclaimer, the term of this patent is extended or adjusted under 35 U.S.C. 154(b) by 0 days.

(21) Appl. No.: 12/929,808

(22) Filed: Feb. 17, 2011

(65) Prior Publication Data

US 2011/0200349 A1 Aug. 18, 2011

(30) Foreign Application Priority Data

Feb. 17, 2010 (JP) ..... 2010-032168

(51) Int. Cl.
*G03G 15/00* (2006.01)

(52) U.S. Cl.
USPC ..... 399/74; 399/49

(58) Field of Classification Search
USPC ..... 399/74, 49; 347/236, 246
See application file for complete search history.

(56) References Cited

U.S. PATENT DOCUMENTS 5,761,570 A 6/1998 Sawayama et al.
6,055,386 A 4/2000 Kato et al.
6,125,257 A 9/2000 Sekine et al.
6,160,569 A 12/2000 Fujimori et al.
6,496,677 B2 12/2002 Fujimori
6,501,913 B2 12/2002 Hattori et al.
6,507,720 B2 1/2003 Kabumoto et al.
6,591,077 B2 7/2003 Yanagisawa et al.
7,228,081 B2 6/2007 Hasegawa et al.
7,245,853 B2 7/2007 Muramatsu et al.
7,251,420 B2 7/2007 Fujimori et al.
7,260,335 B2 8/2007 Kato et al.
7,356,288 B2 4/2008 Iwata et al.
7,477,856 B2 1/2009 Yoneda et al.
7,515,844 B2 4/2009 Tanaka et al.

(Continued)

FOREIGN PATENT DOCUMENTS

CN 1862414 A 11/2006
JP 2003248350 A 9/2003

(Continued)

OTHER PUBLICATIONS

Chinese Office Action dated Apr. 16, 2013 for corresponding Chinese Application No. 201110039336.5.

(Continued)

*Primary Examiner* — Billy J Lactaoen
(74) *Attorney, Agent, or Firm* — Harness, Dickey & Pierce

(57) ABSTRACT

An optical sensor attached to an apparatus includes a substrate and a light emitting element mounted on a first surface of the substrate. The light emitting element emits a light to a detection object in parallel to the substrate. A light receiving element is mounted on the first surface of the substrate. The light receiving element receives a regular reflection light reflected by the detection object. The said first surface serves as a positioning reference for positioning the optical sensor on an optical sensor mounting member provided in the apparatus.

21 Claims, 18 Drawing Sheets

(56) References Cited

U.S. PATENT DOCUMENTS

| | | | | |
|---|---|---|---|---|
| 7,551,864 | B2 | 6/2009 | Fujimori et al. | |
| 7,551,866 | B2 | 6/2009 | Watanabe et al. | |
| 7,616,909 | B2 | 11/2009 | Kato et al. | |
| 7,655,936 | B2 | 2/2010 | Sawayama et al. | |
| 7,668,471 | B2 | 2/2010 | Takeuchi et al. | |
| 7,672,602 | B2 | 3/2010 | Ariizumi et al. | |
| 7,747,182 | B2 | 6/2010 | Kato et al. | |
| 7,796,902 | B2 | 9/2010 | Watanabe et al. | |
| 7,809,291 | B2 | 10/2010 | Takeuchi et al. | |
| 7,821,677 | B2 | 10/2010 | Tanaka et al. | |
| 7,881,629 | B2 | 2/2011 | Takeuchi et al. | |
| 2001/0051062 | A1 | 12/2001 | Yanagisawa et al. | |
| 2002/0003975 | A1 | 1/2002 | Fujimori | |
| 2002/0009310 | A1 | 1/2002 | Kabumoto et al. | |
| 2002/0031375 | A1 | 3/2002 | Hattori et al. | |
| 2004/0251435 | A1* | 12/2004 | Sawayama et al. | 250/559.16 |
| 2005/0089347 | A1 | 4/2005 | Muramatsu et al. | |
| 2005/0207766 | A1 | 9/2005 | Hasegawa et al. | |
| 2006/0002724 | A1 | 1/2006 | Fujimori et al. | |
| 2006/0024076 | A1 | 2/2006 | Kato et al. | |
| 2006/0133834 | A1 | 6/2006 | Yoneda et al. | |
| 2006/0140679 | A1 | 6/2006 | Iwata et al. | |
| 2006/0274628 | A1* | 12/2006 | Tanaka et al. | 369/100 |
| 2006/0280530 | A1* | 12/2006 | Andoh | 399/301 |
| 2007/0019976 | A1 | 1/2007 | Watanabe et al. | |
| 2007/0025748 | A1 | 2/2007 | Ishibashi et al. | |
| 2007/0110457 | A1 | 5/2007 | Kato et al. | |
| 2007/0116480 | A1 | 5/2007 | Takeuchi et al. | |
| 2007/0122168 | A1 | 5/2007 | Tanaka et al. | |
| 2007/0122171 | A1 | 5/2007 | Fujimori et al. | |
| 2007/0269228 | A1 | 11/2007 | Takeuchi et al. | |
| 2008/0025742 | A1 | 1/2008 | Kato et al. | |
| 2008/0124107 | A1 | 5/2008 | Takeuchi et al. | |
| 2008/0145078 | A1 | 6/2008 | Tomita et al. | |
| 2008/0170220 | A1 | 7/2008 | Sawayama et al. | |
| 2008/0205923 | A1 | 8/2008 | Takeuchi et al. | |
| 2008/0253793 | A1 | 10/2008 | Ishibashi et al. | |
| 2009/0110413 | A1 | 4/2009 | Takeuchi et al. | |
| 2009/0202263 | A1 | 8/2009 | Yoshida et al. | |
| 2009/0238591 | A1 | 9/2009 | Watanabe et al. | |
| 2009/0263150 | A1 | 10/2009 | Fujimori et al. | |
| 2009/0324267 | A1 | 12/2009 | Yoshida et al. | |
| 2010/0086320 | A1 | 4/2010 | Koizumi et al. | |
| 2010/0086322 | A1 | 4/2010 | Koizumi et al. | |
| 2010/0092188 | A1 | 4/2010 | Hirayama et al. | |
| 2010/0226664 | A1 | 9/2010 | Yoshida et al. | |
| 2011/0229243 | A1* | 9/2011 | Shiba et al. | 400/618 |

FOREIGN PATENT DOCUMENTS

| | | | |
|---|---|---|---|
| JP | 2004309292 | A | 11/2004 |
| JP | 2005037585 | A | 2/2005 |
| JP | 2005091252 | A | 4/2005 |
| JP | 2006139180 | A | 6/2006 |
| JP | 2006317531 | A | 11/2006 |
| JP | 2008-185848 | | 8/2008 |

OTHER PUBLICATIONS

Japanese Office Action dated Aug. 23, 2013 for corresponding Japanese Application No. 2010-32168.

* cited by examiner

FIG. 26A

| | |
|---|---|
| FORMULA 1 | $\Delta$Vsp_reg. [n]=Vsp_reg. [n]−Voffset_reg |
| FORMULA 2 | $\Delta$Vsp_dif. [n]=Vsp_dif. [n]−Voffset_dif |
| FORMULA 3 | $\alpha$=min($\Delta$Vsp_reg[n]/Vsp_Dif.[n]) |
| FORMULA 4 | $\Delta$Vsp_reg. _dif.[n]=$\Delta$Vsp_dif.[n]×$\alpha$ |
| FORMULA 5 | $\Delta$Vsp_reg._reg.[n]=$\Delta$Vsp_reg.[n]−$\Delta$Vsp_reg._dif.[n] |
| FORMULA 6 | $\beta$[n]=$\Delta$Vsp_reg._reg/$\Delta$Vsg_reg._reg(=EXPOSURE RATE OF BACKGROUND OF TRANSFER BELT) |
| FORMULA 7 | $\Delta$Vsp_dif'=[DIFFUSION LIGHT OUTPUT VOLTAGE]−[BELT BACKGROUND OUTPUT]× [NORMALIZATION VALUE OF REGULAR REFLECTION COMPONENT]=$\Delta$Vsp_dif(n)−$\Delta$Vsg_dif×$\beta$(n) |

FIG. 26B

| | |
|---|---|
| FORMULA 8 | $\xi_1 \sum_{i=1}^{m} x[i]^2 + \xi_2 \sum_{i=1}^{m} x[i]^1 + \xi_3 \sum_{i=1}^{m} x[i]^0 = \sum_{i=0}^{m} y[i]x[i]^0 \cdots\cdots(1)$<br>$\xi_1 \sum_{i=1}^{m} x[i]^3 + \xi_2 \sum_{i=1}^{m} x[i]^2 + \xi_3 \sum_{i=1}^{m} x[i]^1 = \sum_{i=0}^{m} y[i]x[i]^1 \cdots\cdots(2)$<br>$\xi_1 \sum_{i=1}^{m} x[i]^4 + \xi_2 \sum_{i=1}^{m} x[i]^3 + \xi_3 \sum_{i=1}^{m} x[i]^2 = \sum_{i=0}^{m} y[i]x[i]^2 \cdots\cdots(3)$ |
| FORMULA 9 | SENSITIVITY CORRECTION COEFFICIENT: $\eta = \dfrac{b}{\xi_1 a^2 + \xi_2 a + \xi_3}$ |
| FORMULA 10 | DIFFUSION LIGHT OUTPUT AFTER SENSITIVITY CORRECTION: $\Delta Vsp_dif'' =$<br>[DIFFUSION LIGHT OUTPUT AFTER BACKGROUND FLUCTUATION CORRECTION] $\times$<br>[SENSITIVITY CORRECTION COEFFICIENT: $\eta$] $= \Delta Vsp_dif'(n) \times \eta$ |

OPTICAL SENSOR WITH POSITIONING REFERENCE SURFACE AND IMAGE FORMING APPARATUS INCORPORATING OPTICAL SENSOR

CROSS REFERENCE TO RELATED APPLICATIONS

This application claims priority under 35 USC §119 to Japanese Patent Application No. 2010-032168, filed on Feb. 17, 2010, the entire contents of which are hereby incorporated by reference herein.

BACKGROUND OF THE INVENTION

1. Field of the Invention

The present invention relates to an optical sensor and an image forming apparatus that incorporates the optical sensor.

2. Discussion of the Background Art

Conventionally, an image forming apparatus is known that executes image quality adjustment control, such as process control, etc., under certain predetermined conditions, such as immediately after power is supplied, a total number of printed sheets reaches a prescribed level, etc.

In such image quality adjustment control involves, for example, a light emitted from a light emitting element of an optical sensor is reflected by a background of a surface of an intermediate transfer belt that serves as a detection object and an image bearer. A light receiving element of the optical sensor then receives the reflection light and outputs a voltage signal in accordance therewith.

Then, a reference toner image having a prescribed shape is formed on a surface of a photoconductor as a detection object and is transferred onto an intermediate transfer belt. Light is emitted from the light emitting element and is reflected by the reference toner image, and such reflection light is received by the light receiving element, so that a corresponding signal (voltage) is outputted in accordance with a reflection light. Then, using the above-mentioned output signal obtained from the background of the surface of the intermediate transfer belt, as a reference, the above-mentioned output signal of the reference toner image is compared to the reference, to ascertain, an amount of attracted toner per unit area of the reference toner image. Based on the thus-obtained tonner attraction amount, an image formation condition as a control target, including but is not limited to a uniform charge voltage, a developing bias, an intensity of optical writing onto a photoconductor, and a toner density of developer, etc., is adjusted so as to keep the attracted toner amount within a prescribed level. By executing the above-mentioned image quality adjustment control, a printing output with a stable consistent image density can be obtained for a considerable period of time.

For the optical sensor, one employing a surface mounting type in which light emitting and light receiving elements are mounted on a surface of a substrate is known as described in Japanese Patent Application Laid Open No. 2005-91252. Specifically, in such an optical sensor, light emitted from the light emitting element in rays parallel to the substrate and reaches the intermediate transfer belt. The light is then reflected in rays parallel to the substrate and is detected by the light receiving element.

Such an optical sensor includes a regular reflection light receiving element that detects a light emitted and regularly reflected by the intermediate transfer belt. In general, an output value of the regular reflection light receiving element of the optical sensor decreases over time due to a change in gloss of the intermediate transfer belt or the like. Thus, correction processing is applied the output value to increase a light intensity of the light emitting element by increasing an input current to be inputted thereto, for example before image adjustment control, so that the output value of the regular reflection light receiving element becomes a prescribed level when the light reaches the intermediate transfer belt. Since the light emitting element is likely damaged when the input current inputted to the light emitting element is excessively increased, a prescribed upper limit of the input current is designated. When the input current required to attain the prescribed level exceeds the prescribed upper limit, the intermediate transfer belt or the like is replaced.

Further, an output of a regular light receiving element of the optical sensor sometimes decreases and does not reach a prescribed level thereof due to variation in an attachment position thereof with regard to an apparatus even in an early stage for reasons as described below.

Specifically, when a reference toner image formed on a belt, such as the intermediate transfer belt is to be detected, rippling of the belt causes inaccurate detection. Thus, the optical sensor is arranged facing a section of the belt winding around a stretching roller. Consequently, a light is emitted from the optical sensor to a curved surface of the belt. Similarly, when a reference toner image on a surface of a drum type photoconductor is detected, a light is also emitted from the optical sensor to a curved belt surface.

In this way, inaccurate attachment of the optical sensor to the apparatus decreases an output of the regular reflection light receiving element as described with reference to FIG. 25.

Specifically, as shown by a solid line in FIG. 25, when a light is emitted onto a curved surface of a detection object 200, an optical sensor is attached determining an attachment angle so that the optical axis is perpendicular to a tangent line through an emission point D1, where light of the detection object 200 is emitted, when viewed from a axial direction.

However, when the attachment position of the optical sensor deviates as shown by a broken line in FIG. 25, the emission point on the detection object 200 is shifted to a point D2, thereby loosing the 90-degree angle of the optical axis to the tangential line contacting an emission point D2. As a result, a regular reflected light strikes the light receiving element at a position deviated from a center on a light receiving surface of the regular reflection light receiving element, and accordingly, a light intensity entering thereto and an output value therefrom decrease.

Consequently, the output value of the regular reflection light receiving element is initially corrected to be a prescribed level, for example before a product is shipped, by increasing the light intensity of the light emitting element. However, when the light intensity is increased by the initial correction before shipping, an input current inputted to the optical element quickly reaches its upper limit. Accordingly, it is important to minimize inaccurate attachment of the optical sensor to the apparatus, and to keep the input current inputted to the light emitting element in an early usage stage as low as possible.

When a surface mounting type element is employed in the above-mentioned light emitting and light receiving elements of the optical sensor, a surface opposite the mounting surface of a substrate on which these light emitting and light receiving elements are mounted, serves as a positioning reference surface.

Inaccurate attachment of the optical sensor to the apparatus is suppressed by tightly contacting the reference surface to an optical sensor mounting member.

However, even if the optical sensor is precisely attached to the apparatus body, a light emission position sometimes deviates due to defective parts precision of the optical sensor itself, thereby sometimes decreasing an output value of the regular reflection light receiving element. Such defective precision of parts can be caused by imprecise mounting of the light emitting and light receiving elements onto the surface of the substrate, as well as variations in the thickness of the substrate itself.

Deterioration in the output of the regular reflection light receiving element caused by dimensional variation of in the parts of the optical sensor themselves can be suppressed to a certain degree if inaccurate mounting of the light emitting and light receiving elements onto the surface of the substrate and variation in the thickness thereof are inspected in an inspection step of the optical sensor, and only those optical sensors passing the inspection are deployed.

However, since only those optical sensors which, when attached to an apparatus, all of attachment errors of light emitting and light receiving elements in relation to the substrate and thickness error of the substrate fall within prescribed tolerances, respectively, a yield percentage is low, thereby increasing the cost.

Further, Japanese Patent Application Laid Open No. 2008-185848 (JP-2008-185848-A) describes an image forming apparatus that includes a moving device for moving an optical sensor to adjust a position thereof. Specifically, even if an incident angle and an emission position of a light with regard to a surface of a detection object deviate due to variation in the optical sensor itself, these deviations are corrected by adjusting the position of the optical sensor, so that decreasing in an output value of a regular reflection light receiving element can be suppressed. As a result, a yield percentage can be improved, restraining production cost increases.

However, in the image forming apparatus of JP-2008-185848-A, a driving device such as motor, etc., is necessitated to move the optical sensor, thereby likely increasing the number of parts and the size of the light emitting and receiving elements as well.

SUMMARY OF THE PRESENT INVENTION

The present invention has been made in view of the above noted and another problems and one object of the present invention is to provide a new and noble optical sensor attached to an apparatus and includes a substrate, a light emitting element mounted on a first surface of the substrate. The light emitting element emits a light to a detection object in parallel to the substrate. A light receiving element is mounted on the first surface of the substrate and receives a regular reflection light reflected by the detection object. The first surface serves as a positioning reference for positioning the optical sensor on an optical sensor mounting member for mounting the optical sensor in an apparatus.

In another aspect, parts other than the light emitting and light receiving elements and are mounted on a surface different from the first surface of the substrate.

In yet another aspect, an image forming apparatus includes an image bearer having a surface to cause a regular reflection of a light, a toner image formation device to form a toner image on the image bearer, and an optical sensor to detect an amount of toner attracted to the image bearer by the toner image formation device. An image density controller is provided to control image density based on a detection result of the optical sensor. The optical sensor is the optical sensor as described above.

In yet another aspect, a section of the optical sensor mounting member facing the parts mounted on the first surface of the substrate and is concaved so as not to contact the parts when the first surface of the substrate tightly contacts the optical sensor mounting member.

In yet another aspect, the optical sensor faces a curved surface of the detection object.

In yet another aspect, the image bearer is constituted by a belt stretched around plural rollers, while the optical sensor faces one of the plural stretching rollers.

In yet another aspect, the optical sensor is attached to the optical sensor mounting member such that a hypothetical extension of an optical axis of its light passes through a rotational center of one of the rollers.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 26A and 26B collectively illustrate various formulas utilized in various embodiments of the present invention.

DESCRIPTION OF THE PREFERRED EMBODIMENTS

Figure 2:
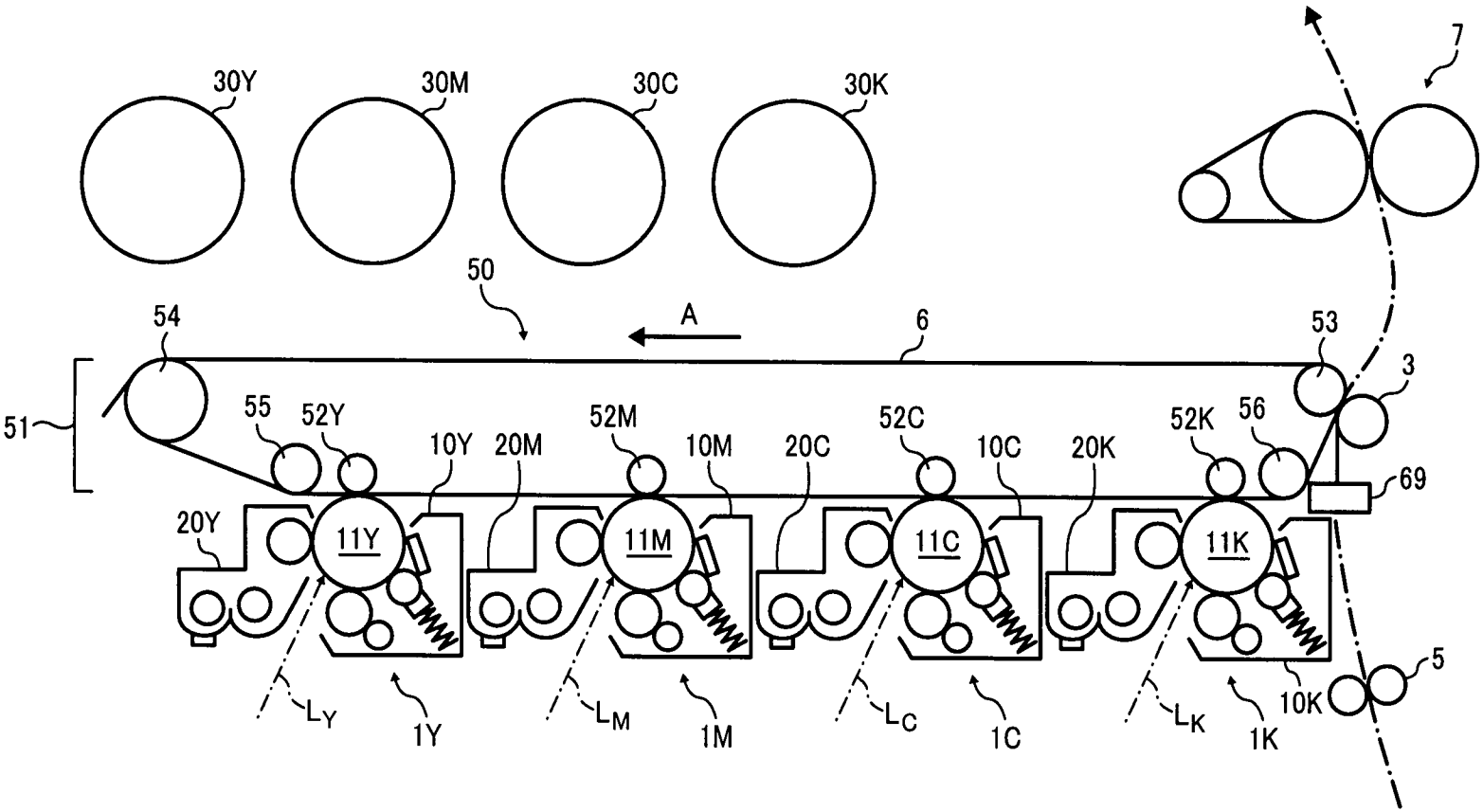
FIG. 2 illustrates an exemplary configuration of a printer according to one embodiment of the present invention.

Referring now to the drawings, wherein like reference numerals and marks designate identical or corresponding parts throughout several figures, in particular in FIG. 2, a laser printer includes four process units 1Y to 1K of image forming devices for forming images of mono colors of magenta, cyan, yellow, and black, respectively. These process units 1Y to 1K include drum type photoconductors 11Y to 11K of image bearers and developing devices 20Y to 20K, respectively.

Above the four color process units 1Y to 1K, there is provided a transfer unit 50 that endlessly conveys an intermediate transfer belt 6 serving as an image bearer counter clockwise in the drawing while stretching thereof. The transfer unit 50 includes a belt cleaning unit 51, four primary transfer rollers 1M to 1K, a secondary transfer backup roller 53, plural driven rollers 54 and 55, and a driving roller 56 or the like in addition to the intermediate transfer belt 6. Thus, the intermediate transfer belt 6 is endlessly moved counter clockwise in the drawing by the driving roller 56 being stretched by these rollers. These four primary transfer rollers 52Y to 52K form primary transfer nips by sandwiching the intermediate transfer belt 6 with the photoconductors 11Y to 11K, respectively.

A transfer bias is applied to a rear surface (i.e., a loop inner surface) of the intermediate transfer belt 6 with a polarity (e.g. a positive one) opposite to that of toner. As the intermediate transfer belt 6 endlessly moves and passes through the primary transfer nips for Y to K uses one after another, toner images of Y to K colors carried on the photoconductors 11Y to 11K are superimposed on the front side surfaces of the intermediate transfer belt 6 during a primary transfer process. As a result, the superimposed four color toner images are formed on the intermediate transfer belt 6 as a color image, and is conveyed to a secondary transfer section between the intermediate transfer belt 6 and secondary transfer roller 3 as the intermediate transfer belt 6 travels.

Further, the laser printer includes an optical writing unit, not shown, below the process units 1Y to 1K to form latent images and a sheet cassette, not shown, yet below the optical writing unit in addition to the process units 1Y to 1K. A conveyance path is formed as shown by a dashed line to convey a transfer sheet. A transfer sheet fed from the sheet cassette is conveyed by a conveyance roller being guided by a conveyance guide, not shown, until a registration roller 5 which is provided at a temporal stopping position. The transfer sheet is then supplied to the secondary transfer section at a prescribed time from the registration roller 5. Then, the color image carried on the intermediate transfer belt 6 is transferred onto the transfer sheet during a secondary transfer process so that a color image is carried thereon. The transfer sheet with the color image is subjected to a fixing process and the color image is fixed in a fixing unit 7. The transfer sheet is then ejected onto a sheet ejection tray 8.

Figure 3:
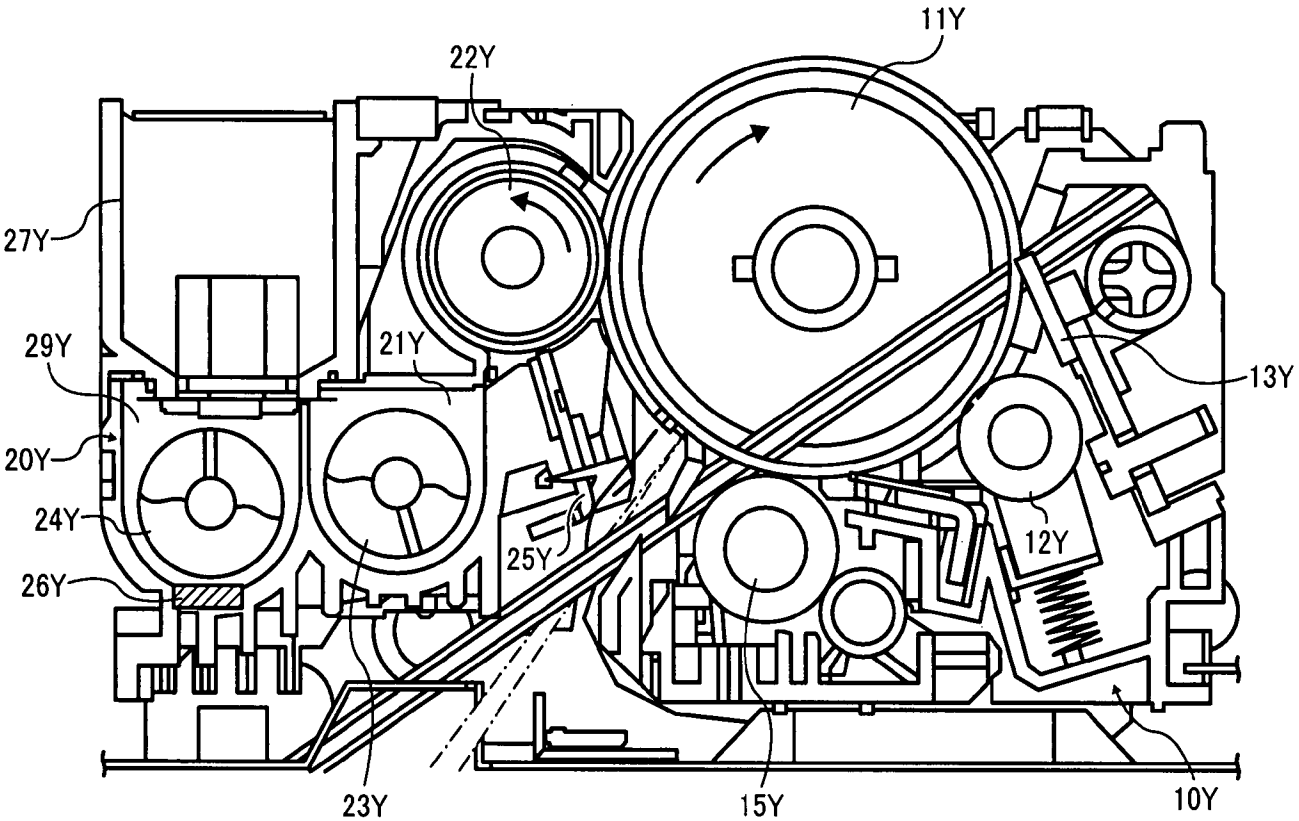
FIG. 3 illustrates an exemplary process unit.

Now, an exemplary schematic configuration of the yellow process unit 1Y is typically described among the above-mentioned process units 1Y to 1K with reference to FIG. 3. Specifically, the process units 1M to 1K have substantially the same configuration as that of the process unit 1Y. As shown, the process unit 1Y includes the photoconductor unit 10Y and the developing device 20Y as mentioned above. The photoconductor unit 10Y includes a cleaning blade 13Y that executes cleaning of the surface of the photoconductor 11Y and a charge roller 15Y that uniformly charges the surface thereof beside the photoconductor 11Y. Further included is a lubricant coating and charge removing brush roller 12Y that a coats the surface of the photoconductor with lubricant and removes charge thereon. A brush section of the lubricant coating and charge removing brush roller 12Y is composed of conductive fabric. The lubricant coating and charge removing brush roller 12Y also includes a metal core connected to a charge removing power supply, not shown, that receives and provides a charge removal bias thereto.

The surface of the photoconductor 11Y is uniformly charged by the charge roller 15Y to which a bias voltage is applied in the photoconductor unit 10Y in the above-mentioned configuration. When a laser light Ly modulated and deflected by the optical writing unit is irradiated and scans the surface of the photoconductor 11Y, a latent image is formed thereon. The latent image on the photoconductor 11Y is developed by the developing device 20Y mentioned later and becomes a yellow toner image. The toner image carried on the photoconductor 11Y is transferred onto the intermediate transfer belt 6 at the primary transfer section where the photoconductor 11*y* faces the intermediate transfer belt 6. The surface of the photoconductor 11Y is subjected to a cleaning process executed by the cleaning blade 13Y after the toner transfer process, and is supplied with a prescribed amount of lubricant. Charge carried thereon is removed by the lubricant coating and charge removing brush roller 12Y to prepare for the next latent image formation.

Figure 4:
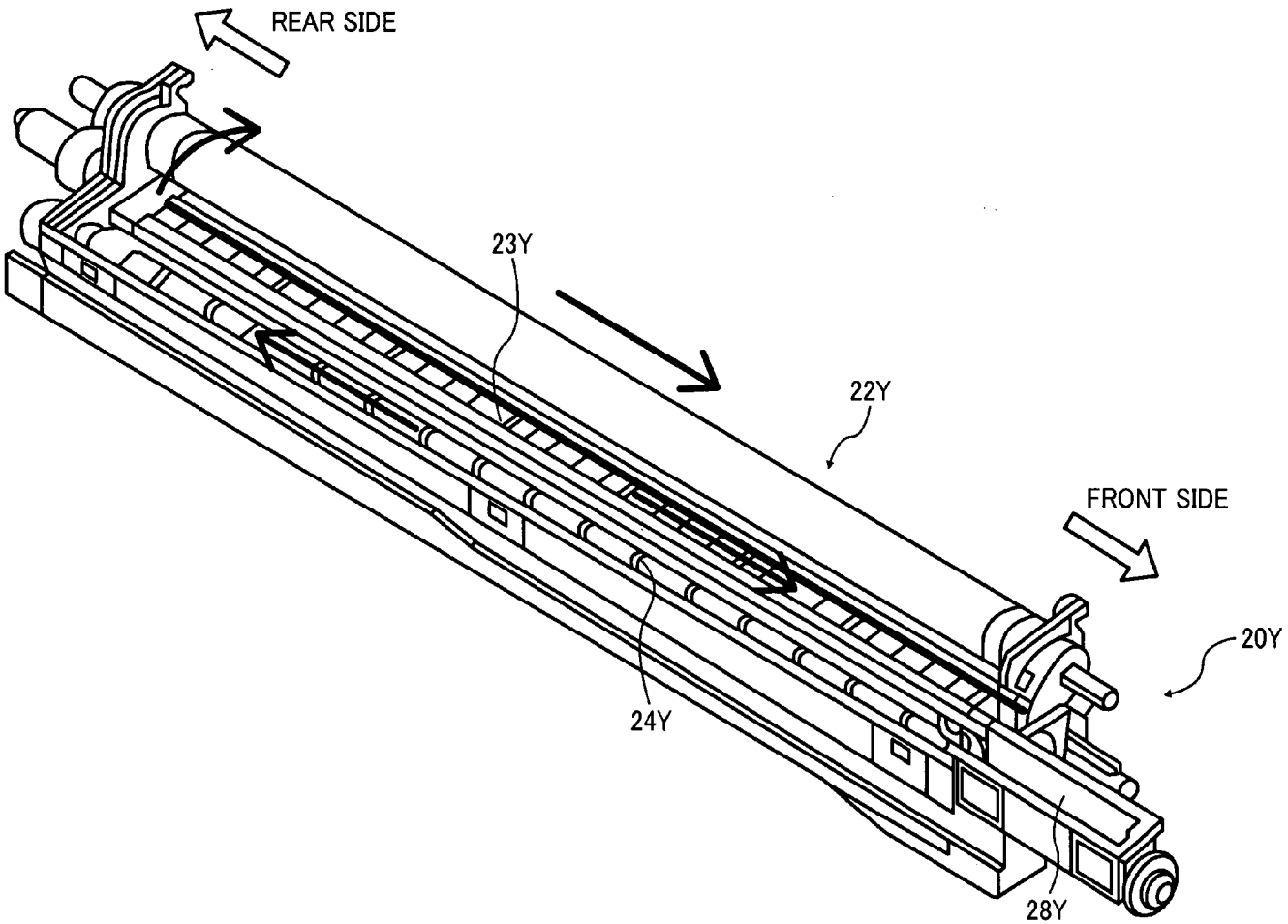
FIG. 4 illustrates an exemplary developing device provided in the process unit.

Now, an exemplary configuration of the developing device 20Y is described with reference to FIG. 4. As shown, the developing device 20Y includes a first agent container 29Y having a first conveyance screw 24Y that conveys developer. The developing device 20Y also includes a second agent container 21Y having a second conveyance screw 23Y that conveys developer, a developing roller 22Y that bears the developer, and a doctor blade 25Y that determines a layer thickness of the developer. These two agent containers collectively form a circulation path and store two component yellow developer composed of magnetic carrier and yellow toner with negative electric charge polarity. The first conveyance screw 24Y is driven and rotated by a driving device, not shown, to convey the yellow developer in the first container 29Y toward a rear side of the printer (i.e., a backside when viewed in a direction perpendicular to a sheet of FIG. 3). The yellow developer conveyed to one end of the first agent container 29Y by the first conveyance screw 24Y enters the second agent container 21Y via a communication hole.

The second screw 23Y in the second container 21Y conveys the yellow developer toward a front side of the printer (i.e., a front side when viewed in a direction perpendicular to a sheet of FIG. 3) when driven and rotated by a driving, device, not shown.

The developing roller 22Y is arranged above the second conveyance screw 21Y in parallel to the second screw 23Y. The developing roller 22Y is composed of a non-magnetic sleeve driven and rotated clockwise and a magnetic roller securedly arranged in the developing sleeve. The yellow developer conveyed by the second conveyance screw 21Y is partially lifted up by a magnetic force generated by the magnetic roller onto a surface of the developing sleeve. Then, a layer of the yellow developer is smoothed to have a prescribed thickness by the doctor blade 25Y held by a casing to create a prescribed gap from the surface of the developing sleeve. The yellow developer is then conveyed to a developing region facing the photoconductor 11Y and is attracted to a latent image for y use on the photoconductor 11Y, so that a y toner image is formed thereon. The yellow developer having consumed y toner during the developing process is returned onto the second conveyance screw 23Y as the developing sleeve rotates. The yellow developer thus conveyed to an end of the second agent container 21Y by the second conveyance screw 23Y then returns to the first agent container 29Y through the communication hole. In this way, the yellow developer circulates and is conveyed in the developing device.

Figure 1A:
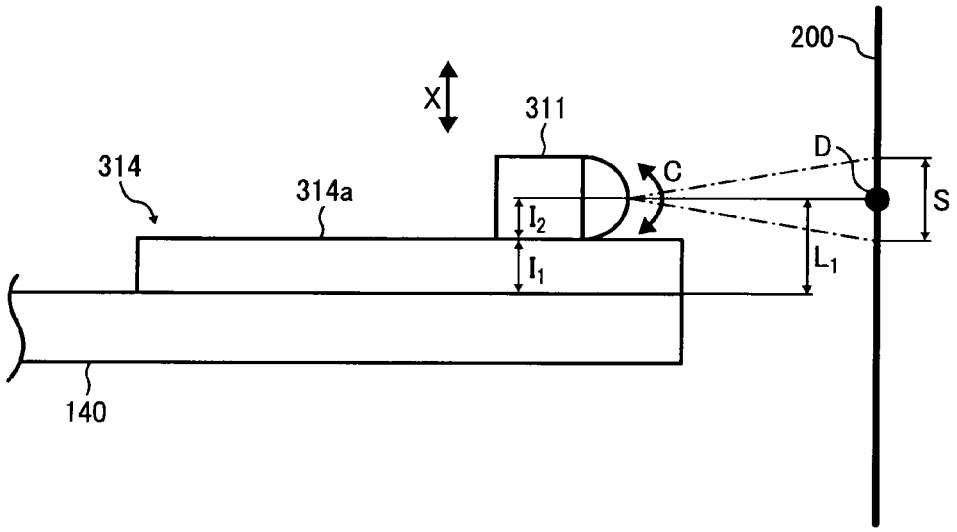
FIG. 1A illustrates deviation of a light emission position in a conventional system.
Figure 1B:
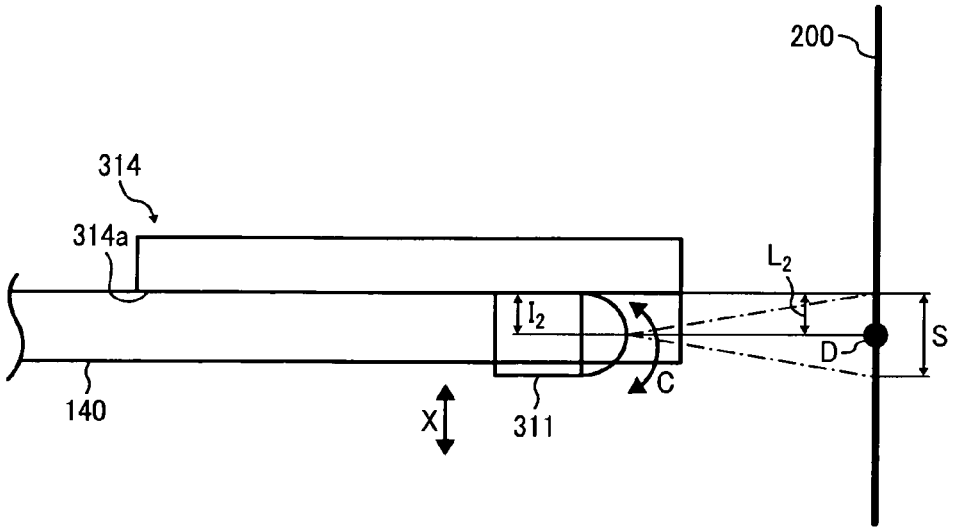
FIG. 1B illustrates deviation of a light emission position according to one embodiment of the present invention.

A toner density of the developer stored in the developing casing is controlled within a prescribed appropriate range, by replenishing fresh toner thereto by a powder pump 27Y from a toner cartridge 30Y shown in FIG. 1 in accordance with an output value Vt of a toner sensor 26Y when the toner is consumed and toner density of the developer decreases during image formation.

Specifically, when a difference value Tn ($=Vt_{ref}-Vt$) between an output value Vt and a target output value $Vt_{ref}$ that provides a toner density control reference is positive, it is determined that the toner density is sufficiently high and the fresh toner is not replenished. By contrast, when the difference value Tn is negative, an amount of toner to be replenished is increased in proportion to an absolute value thereof, so that the output value Vt approaches the target output value $Vt_{ref}$.

Further, only the black use photoconductor 11K arranged most downstream contacts the intermediate transfer belt 6 and the transfer nip all the time among the four photoconductors 11Y to 11K. Specifically, the remaining photoconductors are enabled to either contact or separate therefrom. Specifically, when a color image is formed on a transfer sheet, all of these four photoconductors 11Y to 11K contact the intermediate transfer belt 6. Whereas when a monochrome image of a black color is formed on a transfer sheet, only the black use photoconductor 11K contacts the intermediate transfer belt 6, while the remaining photoconductors 11Y to 11C are separated therefrom.

On the upstream side of the secondary transfer section when viewed in an intermediate transfer belt surface moving direction, there is provided an optical sensor 69 via a prescribed gap. The optical sensor 69 includes plural detection sections respectively facing a center and both widthwise ends of the intermediate transfer belt 6 wound around the driving roller 56. The central optical sensor is used to detect both a toner attraction amount with all of the detections sections and positional deviation with both end detection sections.

Now, a configuration of an exemplary peripheral of the central detection section of the optical sensor 69 is described with reference to FIG. 5. As shown, the optical sensor 69 includes a light emitting element 311, a regular reflection light receiving element 312 to sense a regular reflection light, and a diffusion reflection light receiving element 313 to sense a diffusion reflection light. These elements 311, 312, and 313 are mounted on a print substrate 317 being encapsulated in casings 315. The element 312 receives and senses a regular reflection light that is emitted from the light emitting element 311 in parallel to the substrate, arrived at the intermediate transfer belt 6, and is regularly reflected by either the surface of the intermediate transfer belt or a toner patch transferred thereon. The element 312 then outputs a voltage in accordance with an amount of the regular reflection light received and sensed. Further, the element 313 receives and senses diffusion light reflected by either the surface of the intermediate transfer belt or a toner patch transferred thereon, and outputs a voltage in accordance with an amount of the diffusion light received and sensed.

The light emitting element 311 employs a GaAs light emission diode (LED) having a peak light emission wavelength at 940 nm.

The regular reflection light emitting element 312 and the diffusion reflection light receiving element 313 employ a Si photo-transistor having a peak spectroscopic sensitive wavelength at 850 nm. Specifically, the optical sensor detects an infrared light having wavelength greater than 830 nm where a reflection rate is not significantly different per color.

Thus, with the above-mentioned optical sensor, toner patches of all of Y to K colors can be detected by only one sensor.

Figure 6:
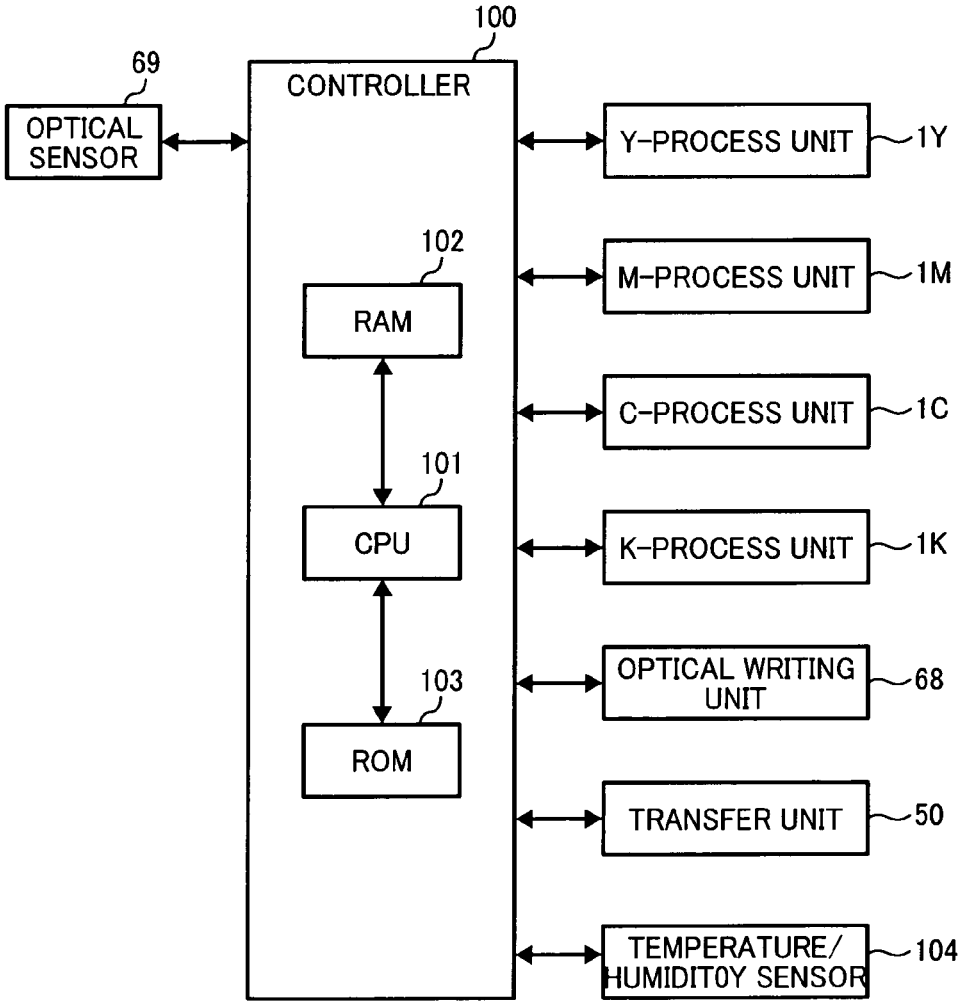
FIG. 6 illustrates a principal part of an exemplary electric circuit.

Now, a principal part of an exemplary electrical circuit employed in a copier as one embodiment of the present invention is described with reference to FIG. 6. As shown, a controller 100 includes a CPU 101 that executes calculation, a RAM that stores non-volatile data, and a ROM 103 that stores data, and the like. The controller 100 is connected to the process units 1Y to 1K, the optical writing unit 68, the transfer unit 50, and the optical sensor 69. The controller 100 thus generally controls various devices in accordance with control programs stored in the RAM 102 and ROM 103.

The controller 100 also controls conditions on image formation. For example, the controller 100 separately applies a bias to each of respective charge members included in the process units 1Y to 1K, so that each of the photoconductors 11Y to 11K is uniformly charged to have a prescribed voltage for each of Y to K uses thereon. The controller 100 separately controls power of four semiconductor lasers included in the optical writing unit 68 corresponding to the process units 1Y to 1K. The controller 100 further controls application of developing biases of the respective Y to K uses to the developing rollers provided in the process units 1Y to 1K, so that a developing potential is generated between latent images of the photoconductors 11Y to 11K and the developing sleeves to electro statically move toner from the sleeve surface to the photoconductive member, thereby developing the latent images.

Figure 7:
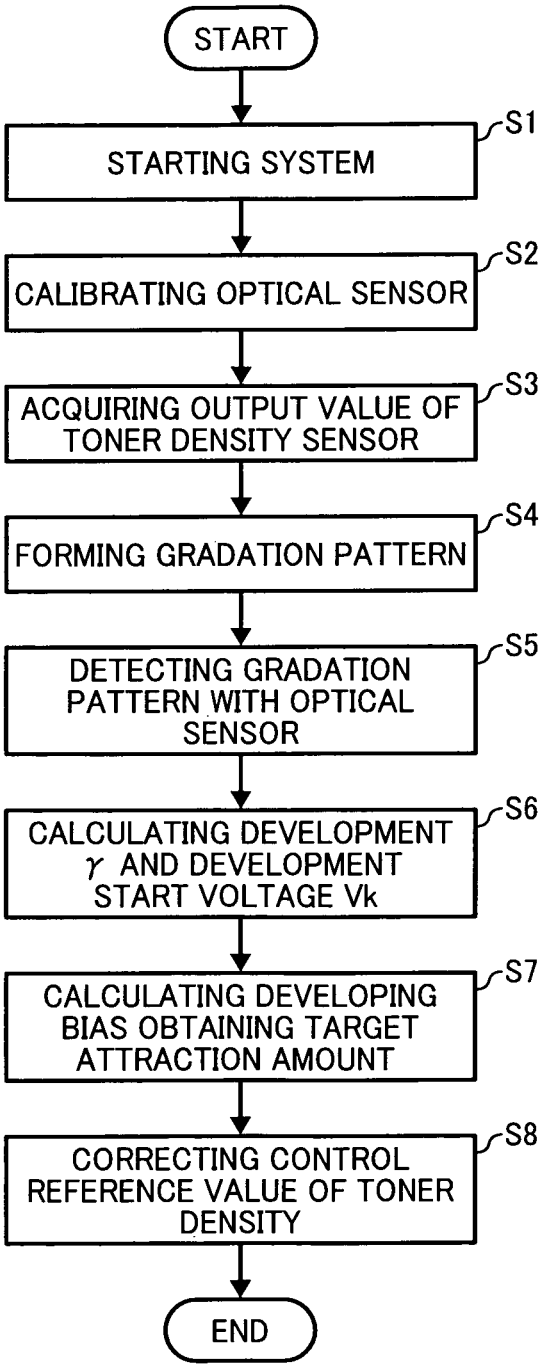
FIG. 7 illustrates an exemplary sequence of a process control.

The controller 100 also executes process control to keep image density of each of respective colors whenever power is supplied or a prescribed number of sheets have been printed as shown in FIG. 7. Specifically, when the power is supplied and the apparatus starts up in step S1, the controller 100 adjustments the optical sensor 69 in step S2. Specifically, an amount of current inputted to the light emitting element 311 is changed to adjust a light intensity thereof so that an output value of the regular reflection light receiving element 312 enters a prescribed range. Since the light intensity increases when the input current inputted to the light emitting element 311 increases, the output value of the regular reflection light also increases. By contrast, when the light intensity decreases, the output value of the regular reflection light decreases. Further, to correct the above-mentioned optical sensor, the light emitting element 311 is turned on, and a regular reflection light value of the background of the intermediate transfer belt is initially detected. Then, an input current value Ifsg inputted to the light emitting element 311 is adjusted so that a regular reflection light output value becomes 4±0.5 volt. An input current Ifsg that enables the regular reflection light output value to be closest to 4.0V may be detected using a binary search.

When the regular reflection light output value does not enter the range 4±0.5 volt as a result of the binary search, correction of the optical sensor is failed. When such failure repeats three times, the controller 100 recognizes that abnormality occurs and stops operation of a machine. The upper limit of 30 mA is assigned to the input current Ifsg to prevent breakage of the light emitting element 311. When the regular reflection light output value enters the prescribed range, the input current value Ifsg obtained at that time is stored in a main body.

Since correction of the optical sensor 69 takes a log time period, a light is emitted onto the background of the intermediate transfer belt for a prescribed time period using an input current Ifsg used in the previous adjustment. Then, a reflection light is detected and an average of the detected regular reflection light output is calculated. When it is determined that the average is within the prescribed range, correction of the optical sensor may be omitted.

Figure 8:
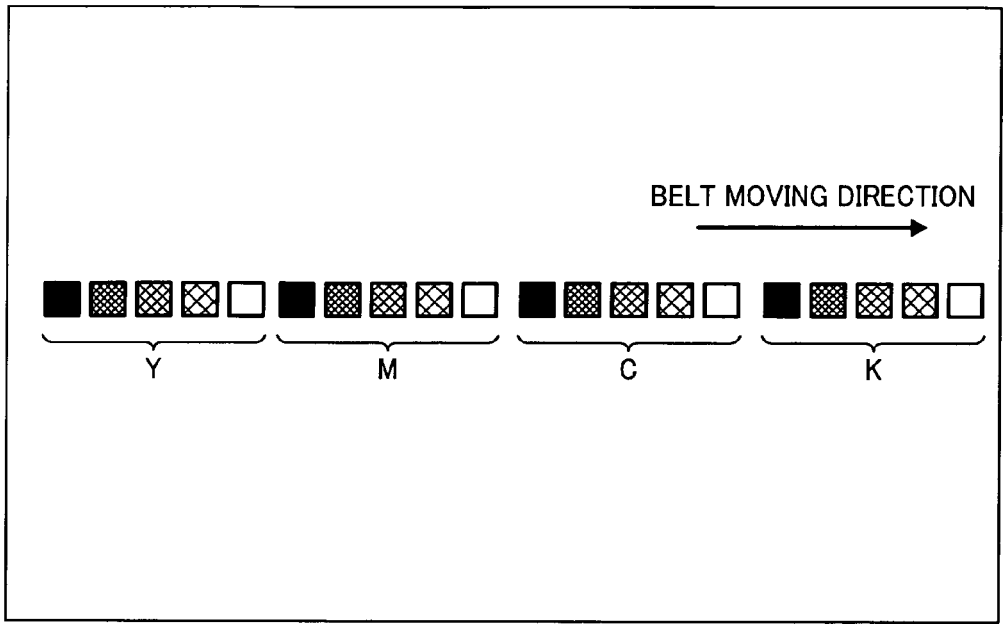
FIG. 8 illustrates an exemplary gradation sequence pattern formed on an intermediate transfer belt.

When it obtains an output value Vt of the toner density sensor 26Y to know toner density of developing devices of respective colors, the controller 100 automatically forms a gradation sequence pattern at a prescribed position per color on the intermediate transfer belt 6 facing the optical sensor 69 as shown in FIG. 8 in step S4. Each of the gradation patterns of the respective colors includes about five toner patches, and is formed in K-Y color order at an interval of 5.6 mm on the intermediate transfer belt 6. Each of the toner patches has a width of 10 mm in a main scanning direction and that of 14.4 mm in the sub scanning direction. The gradation pattern is formed by changing conditions of a charge and a developing bias per toner patch while fixing an exposure condition to a prescribed level, which is a full exposure level capable of sufficiently removing charge on a photoconductor. A developing bias and a charge bias designated for each toner patch included in the gradation pattern are described later in detail. Such gradation patterns of the respective colors on the intermediate transfer belt are optically detected by the optical sensor 69 in step S5.

Subsequently, the output value Vt is converted into a toner attraction amount (i.e., image density) using attraction amount calculation algorithm that is established based on an output value of the light emitting element obtained by detecting each of respective toner patches of the gradation patterns of respective colors and a relation between that and an amount of attraction toner.

The toner attraction amount is calculated based on a regular reflection light regularly reflected by a toner patch and a diffusion reflection light reflected therefrom as described in Japanese Patent Application Laid Open No. 2006-139180. As a result, a detection range can be broadened at a large amount attraction level in comparison with a system that only employs the regular reflection light. Further, due to the algorithm described in the Japanese Patent Application Laid Open No. 2006-139180, detection of a toner attraction amount can be accurate even if outputs of the light emitting element and light receiving element change and the intermediate transfer belt 6 deteriorates as time elapses.

Now, exemplary attraction amount calculation algorithm employed in one embodiment of the present invention is described, wherein legends represent the below listed values;

Vsg represents an output voltage of an optical sensor that detects a background of a transfer belt (i.e., a background detection voltage), Vsp represents an output voltage value of an optical sensor that detects each of reference patches (i.e., a patch detection voltage), Voffset represents an offset voltage (i.e., an output voltage value when an LED is turned OFF, _reg represents a regular reflection light output (abbreviation for Regular Reflection), _dif represents a diffusion reflection light output (abbreviation for Diffuse Reflection) (cf. JIS Z 8105 is a term related to color), and [n] represents a number of factors, which are array variable of n.

Initially, attraction amount calculation algorithm for K toner is described. First, an offset voltage is subtracted from a regular reflection light (output voltage) using the below described formulas;

$$\Delta Vsg_\mathrm{reg}[K][n]=Vsg_\mathrm{reg}[K][n]-V\mathrm{offset_reg}, \text{ and}$$

$$\Delta Vsp_\mathrm{reg}[K]=Vsg_\mathrm{reg}[K]-V\mathrm{offset_reg}[K].$$

Second, data of the regular reflection light is normalized using the below described formula;

$$\text{Normalization value } Rn[K]=\Delta Vsg_\mathrm{reg}[K][n]/\Delta Vsp_\mathrm{reg}[K].$$

Third, using a look up table (LUT), the normalization value is converted into an attraction amount. For the purpose, an attraction amount conversion table indicating correspondence to a normalization value is previously prepared, and an attraction amount is obtained using the table.

Now, exemplary color toner attraction amount calculation algorithm employed in one embodiment of the present invention is described, wherein the attraction amount is calculated using seven steps of the below described steps S1 to 7.

Specifically, in step S1, Δvsp and ΔVsg are calculated by sampling data. Initially, a difference from an offset voltage is calculated for all of (n) items of reference patches in addition to a regular reflection light output and a diffusion reflection light output to finally represent an increase of a sensor output only by an increase of a change of an attraction amount of color toner.

Figure 9:
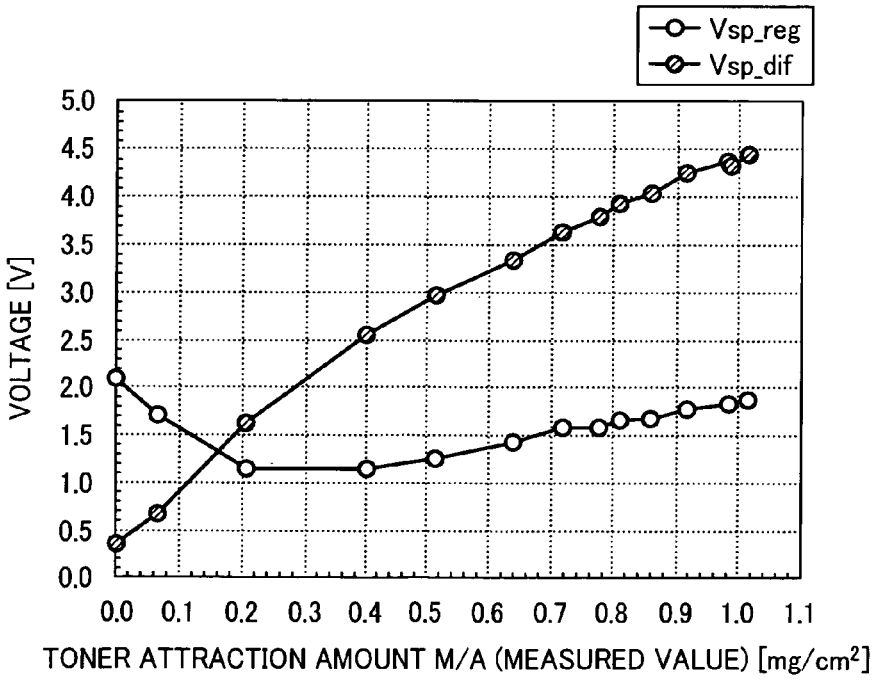
FIG. 9 illustrates an exemplary relation between an amount of toner attracted to a toner patch, a Vsp, and a Vsg.

The increase in the regular reflection light output is obtained using the first formula as listed in FIG. 26A. The increase of the diffusion reflection light output is obtained using the second formula as listed in FIG. 26A. However, when an operation amplifier that causes a sufficiently small and negligible offset output voltage value (e.g. Voffset_reg and Voffset_dif) is employed, the above-mentioned differential processing can be omitted. By executing the step S1, a characteristic curve as shown in FIG. 9 is obtained.

Figure 10:
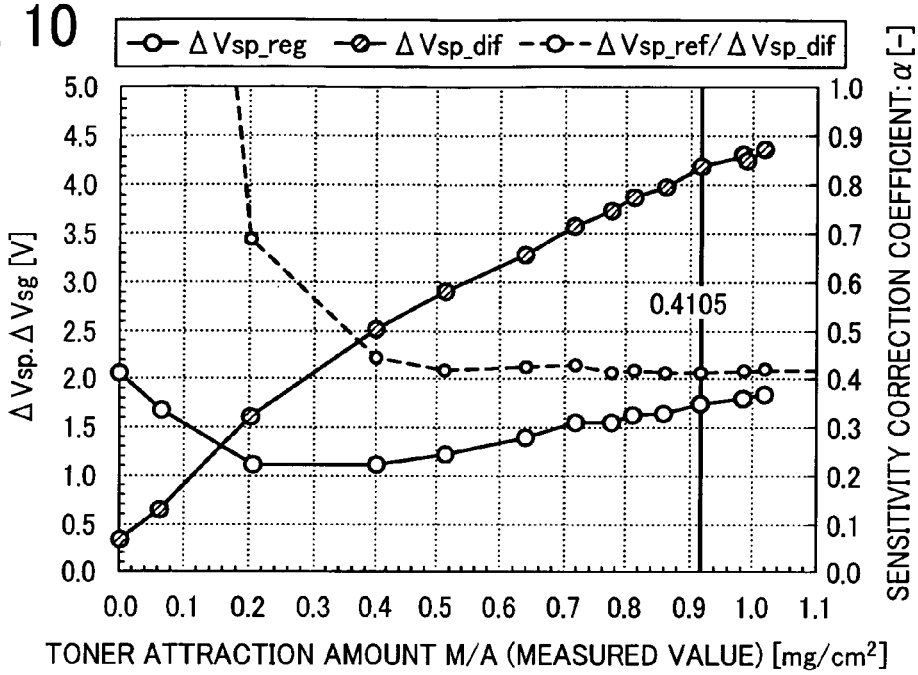
FIG. 10 illustrates an exemplary relation between an amount of toner attracted to a toner patch, Δ (delta) Vsp, ΔVsg, and a sensitivity correction coefficient α.

In step S2, a sensitivity correction coefficient α (alpha) is calculated. Specifically, ΔVsp_reg[n]/ΔVsp_dif[n] is initially calculated per reference patch based on the "ΔVsp_reg. [n]" and "ΔVsp_dif. [n]" obtained in step S1. When a component of the regular reflection light output is decomposed in step S3 mentioned later, the sensitivity correction coefficient α to be multiplied by the diffusion light output (ΔVsp_dif[n]) is calculated using the third formula as listed in FIG. 26A. By executing step S2, another characteristic curve is obtained as shown in FIG. 10. The sensitivity correction coefficient α is the minimum among the ΔVsp_reg[n] and the Vsp_Dif. [n], because it is previously known that the minimum of a regular reflection component of the regular reflection light output is positive and is almost zero.

Figure 11:
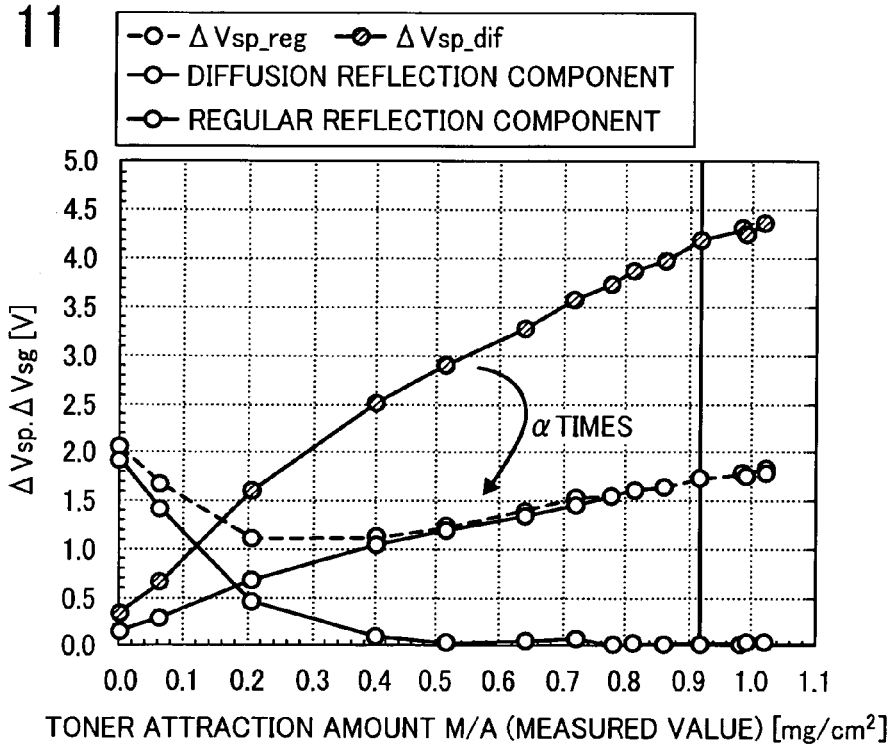
FIG. 11 illustrates an exemplary relation between an amount of toner attracted to a toner patch, a diffusion reflection component, and a regular reflection component.

In step S3, a component of a regular reflection light is decomposed. Specifically, a diffusion component of a regular reflection light output is obtained using the fourth formula as listed in FIG. 26A. A regular reflection component of a regular reflection light output is obtained using the fifth formula as listed in FIG. 26A. As a result of the above-mentioned component decomposition, the regular reflection component of the regular reflection light output becomes zero at a patch detection voltage where a sensitivity correction coefficient $\alpha$ is known. Further, the regular reflection light output is decomposed to regular reflection light and diffusion components as shown in FIG. 11.

In step S4, the regular reflection component of the regular reflection light output is normalized by obtaining a ratio between a background detection voltage and each of patch detection voltages while converting the same into normalization numerals from 0 to 1 using a sixth formula as listed in FIG. 26A.

In step S5, a background variation in a diffusion light output is corrected as described below. Initially, an output component of a diffusion light from a background of a belt is removed from a diffusion light output voltage by using a seventh formula as listed in FIG. 26A.

Figure 12:
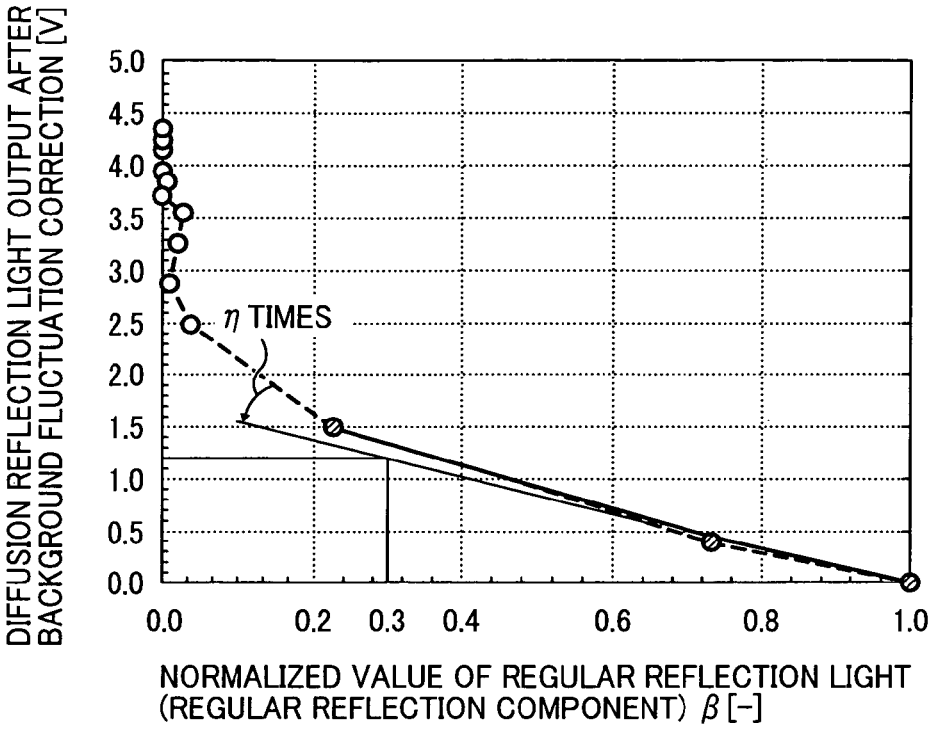
FIG. 12 illustrates an exemplary relation between a normalization value of a regular reflection component of a commercially available light shielding and an output value of a diffusion light obtained after correction of a background fluctuation.

In step S6, a sensitivity of a diffusion light output is corrected. Specifically, a diffusion light output having been subjected to the background fluctuation correction is plotted in relation to a normalized value of a regular reflection component of a regular reflection light as shown in FIG. 12. Then, by approximating a line obtained by the plotting, a sensitivity of the diffusion light output is obtained. Then, the sensitivity is corrected to be a prescribed target level.

Specifically, by applying polynomial expression (quadratic expression) approximation to the plotted line obtained by plotting the diffusion light output having been subjected to the background fluctuation correction in relation to the normalized value of the regular reflection light (the regular reflection component), a sensitivity correction coefficient $\eta$ is calculated. More specifically, the plot line is initially approximated with the quadratic expression approximation formula ($y=\xi 1\times 2+\xi 2x+\xi 3$), and coefficients $\xi 1$, $\xi 2$, and $\xi 3$ are obtained using a least-squares method as calculated by an eighth formula as listed in FIG. 26B, wherein m represents a number of data, x[i] represents a normalized value of regular reflection light_ regular reflection component, y[i] represents a diffusion light output having been subjected to background fluctuation correction, and x meets the inequality $0.1\leq x\leq 1.0$. By sorting out simultaneous first to third equations, the above-mentioned coefficients $\xi 1$, $\xi 2$, and $\xi 3$ can be obtained.

Then, a sensitivity correction coefficient $\eta$ that changes a normalized value "a", calculated based on the plotted line thus approximated, to a prescribed value "b" is calculated using a ninth formula as listed in FIG. 26B;

Then, a relation between a toner attraction amount and a diffusion output is corrected using a tenth formula as listed in FIG. 26B to be a prescribed level by multiplying the diffusion light output having been subjected to the background fluctuation correction obtained in step S5 by the sensitivity correction coefficient $\eta$ obtained in step S6.

In step S7, an output value of a sensor is converted into a toner attraction amount. Specifically, since all of corrections have been executed up to step S6 for a change in diffusion reflection output with age caused, for example by decrease in intensity of a LED, an output value of a sensor is finally converted into a toner attraction amount with reference to a toner attraction amount conversion table.

Figure 13:
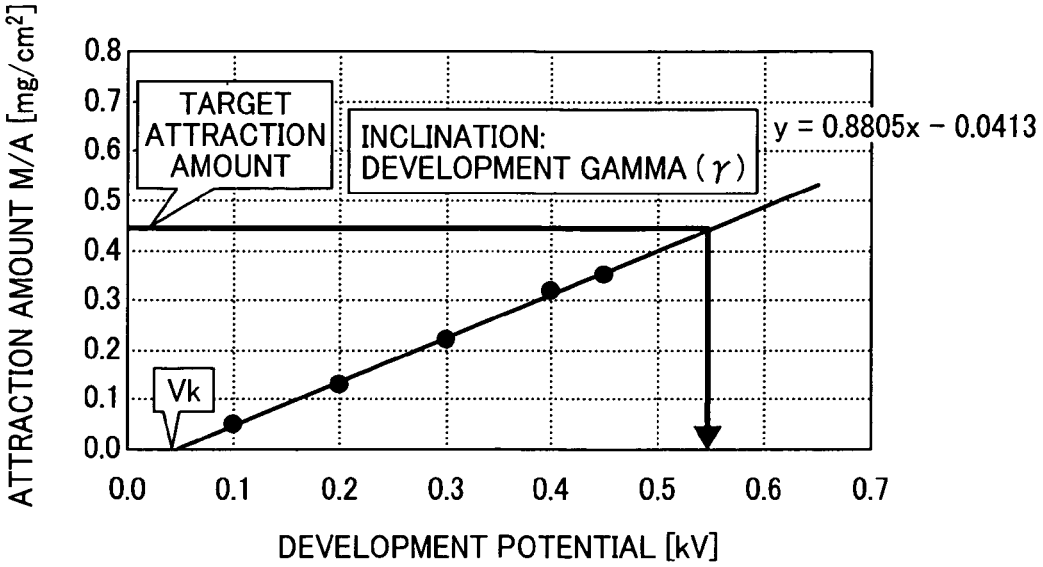
FIG. 13 illustrates an exemplary relation between a developing potential and an amount of attracted toner.

When the toner attraction amount of each of the toner patches has been detected using the above-mentioned toner attraction amount calculation algorithm, a developing potential toner attraction amount straight line ($y=ax+b$) is obtained as a developing characteristic per color using a linear approximation method as shown in FIG. 13 based on a relation between the toner attraction amount of each of the toner patches and the developing potential when each of the toner patches is formed. Based on the developing potential toner attraction amount straight line ($y=ax+b$), developing $\gamma$ (i.e., an inclination "a") and a development start voltage Vk (i.e., a section "b") are calculated per color in step S6.

Then, the controller 100 calculates a developing bias Vb that matches with a developing potential in step S7 to obtain a prescribed target attraction amount. The controller 100 determines a charge bias Vc based on the calculated developing bias Vb, and stores the charge bias Vc and the developing bias Vb in a non-volatile storage, such as a RAM 102, etc. The charge bias Vc is generally higher than the developing bias Vb by an amount of about 100V to about 200V. The developing bias Vb is designated to range from about 400 to about 700V. Specifically, even if a calculated developing bias Vb is 1 kV, 700 v is designated thereto. That is, when the designated developing bias exceeds 700V, a power supply becomes overload and the bias is unlikely stably maintained. By contrast, when the designated developing bias is less than 400V, a designated value to the charge bias becomes too low, resulting in uneven charge, thereby generating an abnormal image called a ghost, which is previously formed but appears on the next image.

When the developing bias Vb has been calculated, the controller 100 corrects the toner density control reference value Vtref in step S8 based on the developing y and the output Vt of the toner density detection sensor 26 obtained in step S3. Specifically, the controller 100 initially calculates a differential value $\Delta\gamma$ (i.e., $\Delta\gamma$=calculated developing $\gamma$-target developing $\gamma$) between the target developing $\gamma$ and the developing $\gamma$. The target developing $\gamma$ may be 1.0 mg/cm$^2$/KV. Specifically, a toner attraction amount is 1.0 mg/cm$^2$ when a developing start voltage Vk is 0V and a developing potential is 1 kV. For example, a developing bias Vb calculated from the target developing $\gamma$ is 550V, when the developing start voltage Vk is 0V, the target attraction amount is 0.5 mg/cm$^2$, and a voltage V1 on the photoconductor after exposure thereto is 50V.

When the differential value $\Delta\gamma$ calculated is out of the prescribed range, a developing bias Vb to be calculated (by the controller 100) in the next developing bias adjustment possibly exceeds the above-mentioned designated range. Accordingly, the developing $\gamma$ is corrected to approach the target developing level $\gamma$ before the next process control by correcting the toner density control reference value Vtref. As a result, prescribed image density is not obtained even using the calculated developing bias. However, a density of toner stored in the developing device does not immediately become the target level and the developing $\gamma$ does not sharply change, because fresh toner is replenished so that the toner density gradually reaches the target. Thus, even if the toner density control reference value Vtref is corrected, a prescribed image density can be obtained even using the calculated developing bias at an initial stage, and image density gradually separates from the prescribed level.

In such a situation, a prescribed amount of correction of the toner density control reference value Vtref is designated so that image density does not largely deviates from the prescribed level even using the calculated developing bias. Thus, the image does not seriously deteriorate. When the gradation sequence pattern is formed, the output value Vt of the toner density sensor 26 is largely different from the toner density control reference value Vtref, and the Vtref is corrected, the developing γ likely separates largely from the target level. To avoid this, it is determined if the toner density control reference value Vtref is corrected or not considering a relation to the output value Vt of the toner density sensor 26 obtained when the gradation sequence pattern is formed. For example, when the below described inequalities are met, the toner density control reference value Vtref is decreased by 0.2V so as to decrease a toner density of the present level;

$$\Delta\gamma \geq 0.30\ \text{mg/cm}^2\text{/kV, and } Vt - V_{tref} \geq -0.2\text{V.}$$

Further, when the below described inequalities are met, the toner density control reference value Vtref is increased by 0.2V so as to increase a toner density of the present level;

$$\Delta\gamma \leq -0.30\ \text{mg/cm}^2\text{/KV, and } Vt - V_{tref} \geq 0.2\text{V.}$$

Yet further, when the below described inequality is met, the toner density control reference value Vtref is not corrected;

$$-0.30\ \text{mg/cm}^2\text{/KV} < \Delta\gamma < 0.30\ \text{mg/cm}^2\text{/KV.}$$

Now, one embodiment of the present invention is described with reference to FIG. 5. As shown, surface mounting type elements 311 to 313 are mounted on a surface of a print substrate 314 as an optical sensor 69. The light emitting element 311 employs a type that emerges a beam from a side surface different than a surface facing the print substrate 314. The light emitting element 311 is mounted on the surface of the print substrate 314 so that a portion having the maximum intensity of the light is emerged in parallel to the print substrate 314 and reaches the intermediate transfer belt 6. The regular reflection light receiving element 312 and the diffusion reflection light receiving element 313 employ light receiving elements each having a light receiving surface at a side surface other than a surface facing the print substrate 314. These elements 312 and 313 are each mounted on the surface of the print substrate 314 to receive a portion of the light reflected from the intermediate transfer belt 6 in parallel to the print substrate 314 among the light reflected therefrom.

By employing the surface mounting type elements 311 to 313, a cost can be saved improving productivity thereof in comparison with a lead type element. Since the light receiving element receives the light emitted and reflected from the intermediate transfer belt 6 each in parallel to the'print substrate 314, the print substrate 314 can be arranged perpendicularly to the surface of the intermediate transfer belt. As a result, the optical sensor can be more compact than a type in which a light is perpendicularly emitted from the print substrate surface to an intermediate transfer belt and a reflection light therefrom is perpendicularly received.

Positional accuracy of the elements 311 to 313 with regard to the print substrate 314 relies on accuracy of their mounting thereon. Since the elements 311 to 313 are mounted on the mounting surface of the print substrate 314 with their surfaces facing the print substrate 314 contacting the mounting surface of the print substrate 314, their positioning in a direction perpendicular to the surface of the print substrate (hereinafter referred to as a X-axis direction) and that around? a direction (hereinafter referred to as a Z-axis direction) perpendicular to both the X-axis direction and an optical axis direction (hereinafter referred to as a Y-axis direction) can be highly precisely executed to some extent. However, their positioning around the X-axis direction is not significantly accurate, because it depends on accuracy of attachment of the elements to the print substrate 314.

The detection accuracy of the diffusion reflection light is not largely influenced by the positional accuracy of the light receiving element 311 and the diffusion reflection light receiving element 313 with regard to the print substrate 314. However, the detection accuracy of the regular reflection light is largely influenced by the positional accuracy of the light receiving element 311 and the regular reflection light receiving element 312 with regard to the print substrate 314. Accordingly, an output of the optical sensor 69 is checked by shipping inspection in a part manufacturing step to determine if an optical element 311 and a regular reflection light receiving element 312 are correctly arranged on a print substrate 314.

Specifically, an optical sensor is corrected in the same manner as mentioned above using a reference reflection member that corresponds to the detection object. Then, a value Ifsg of an input current that flows when the regular reflection light receiving element 312 outputs a prescribed voltage (e.g. 4.0V) is obtained. Subsequently, it is determined if the input current value Ifsg falls within a prescribed range. The upper limit is designated to the input current value Ifsg by supposing an increase when the optical sensor 69 is installed in a machine or a detection system deteriorates as time elapses.

Figure 14:
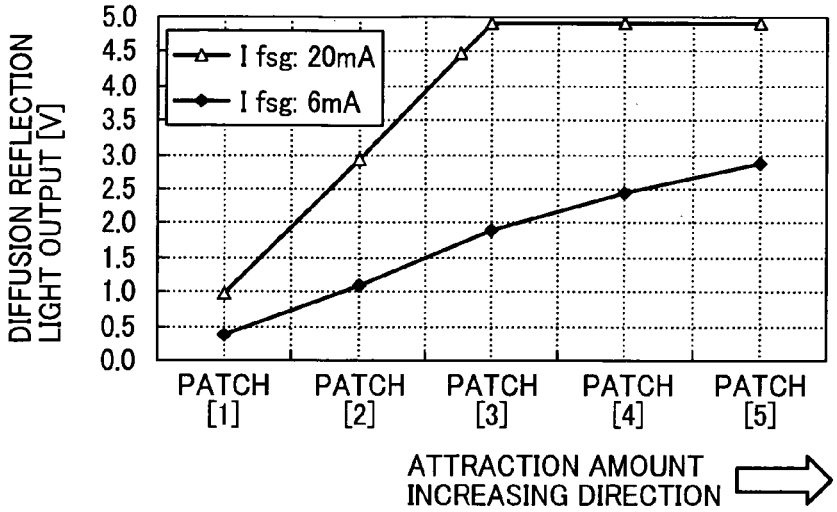
FIG. 14 illustrates an exemplary relation between an input current inputted to a light emitting element and an output of a diffusion reflected light therefrom.

When light intensity of the light emitting element 311 is increased by increasing the input current value Ifsg, a toner attraction amount is not precisely calculated based on an output value of the diffusion reflection light receiving element 313 as a problem. Accordingly, the upper limit of the input current value Ifsg needs to be suppressed to a lower level in comparison with a case when the toner attraction amount is detected based on the regular reflection light for the reason as mentioned with reference to FIG. 14 below, wherein a relation between an input current value Ifsg and a diffusion reflection light output is illustrated. As shown, a lateral axis represents toner patches 1 to 5 increasingly having higher toner attraction levels in this order. A vertical axis represents a diffusion reflection light output obtained from each of the toner patches. Black dots represent diffusion reflection light output values when the toner patches are detected using an input current value White triangles represent diffusion reflection light output values when the toner patches are detected using an input current value Ifsg of 20 mA. As understood therefrom, as the input current value Ifsg increases, the diffusion reflection light output increases. When a toner patch carrying a lot of toner is detected using input current value Ifsg of 20 mA, the diffusion reflection light output exceeds the upper limit and sticks to a ceiling of the graph?. In this way, when the input current value Ifsg is large and accordingly the light intensity of the light emitting element 311 is increased, the patch having the lot of attraction toner and an amount of the attraction toner cannot be accurately detected and calculated. As a result, neither developing coefficient γ nor image density is accurately calculated and stably obtained. For this reason, if the input current value Ifsg and accordingly the light intensity of the light emitting element 311 are suppressed as lower as possible for an early usage stage to have a large allowance needed when the intermediate transfer belt 6 deteriorates as time elapses and the input current value Ifsg increases, a toner attraction amount is accurately detected for a long time period.

Further, when the input current value Ifsg becomes out of the prescribed range as a result of correction of the optical sensor 69, such an optical sensor 69 is not attached to the apparatus body to avoid inaccurate detection of a toner attraction amount.

In this way, by checking an output of the optical sensor 69 before shipment thereof, only optical sensors 69 requiring an input current value Ifsg suppressed within the prescribed range for the initial usage stage are attached to apparatuses. Accordingly, a toner attraction amount can accurately be detected for a long time period.

However, an optical sensor is practically used being attached to a supporting member as an optical sensor attachment in an apparatus body. Consequently, the Input current value Ifsg needs to fall within the prescribed range for the initial usage stage both when it is checked alone and combined with the supporting member.

Accordingly, an output of the optical sensor 69 is checked before shipping in the same manner as mentioned above but being attached to the supporting member. Specifically, an input current value Ifsg that controls a sensor output to be the prescribed level (e.g. 4.0V) is obtained, and it is determined if it falls within the prescribed range. When the Input current value Ifsg is out of the prescribed range, such an optical sensor 69 is not attached to the apparatus body.

As mentioned heretofore, by checking an output of an optical sensor 69 being attached to a supporting member, only a product capable of using an input current value Ifsg within a prescribed range for an initial usage stage can be shipped.

Such a check executed with the optical sensor being attached to the supporter is important to improve a yielding percentage suppressing a manufacturing cost. Then, it has revealed through an investigation that variation in the print substrate 314 causes the input current value Ifsg to be out of the prescribed range when the optical sensor is checked being attached to the supporter. Specifically, the optical sensor 69 is attached to the supporting member with its surface opposite the mount surface, where the optical elements 311 to 313 are mounted, contacting the supporting member as a reference for positioning the optical sensor 69. Thus, when a thickness of the print substrate 314 fluctuates per print substrate 314, a light emission position of the optical sensor 69 deviates toward a direction in which the intermediate transfer belt moves owing to the fluctuation.

As shown in FIG. 2, in the printer, the optical sensor 69 is arranged facing a section of the intermediate transfer belt 6 where the driving roller 56 driving the intermediate transfer belt 6 backs up. Because, if the optical sensor 69 is arranged facing a section of the intermediate transfer belt 6 where the roller of the intermediate transfer belt 6 is absent, the intermediate transfer belt 6 creates waves so that a distance between the optical sensor 69 and the intermediate transfer belt 6 varies, resulting inaccurate detection. However, the arrangement of the optical sensor 69 facing the section of the intermediate transfer belt 6 backed up by the driving roller 56, the optical sensor 69 necessarily detects a curved section thereof.

Figure 15:
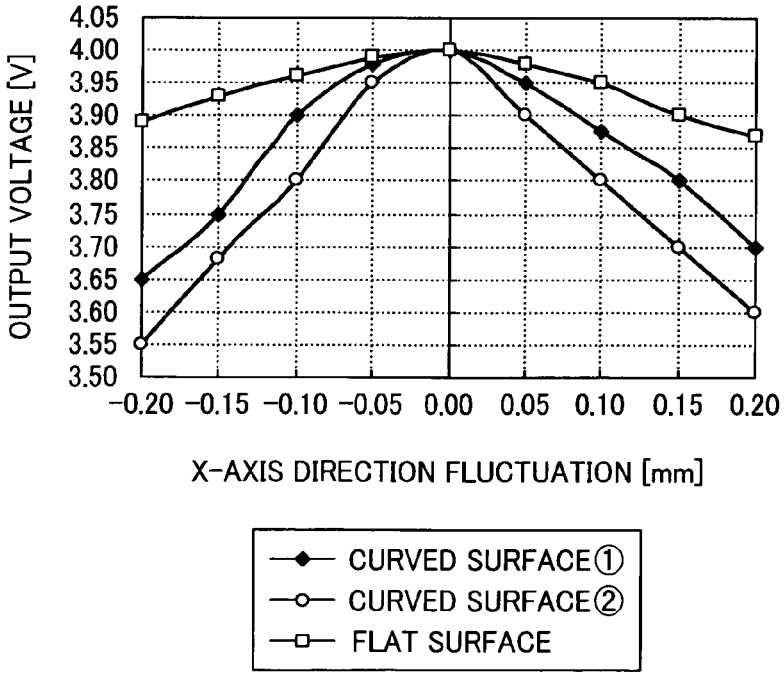
FIG. 15 illustrates an exemplary output voltage of the regular reflected light receiving element when a light emission position of the light emitting element is changed.

Now, an exemplary result of an experiment is described with reference to FIG. 15, wherein output voltages of a regular reflection light receiving element obtained when an emission position of a light of a light emitting element is displaced from a reference position of the optical sensor in a x-axis direction (i.e., a vertical direction in relation to a print substrate) are illustrated. As shown, the optical sensor is corrected at a reference position (0 mm) and an output voltage of a regular reflection light receiving element is adjusted to have 4.0V.

Further, output voltages obtained when a detection object is flat and curved are illustrated together, wherein a radius of a first curvature is smaller than that of a second curvature.

As understood therefrom, the output largely decreases when the detection object is curved than it is flat in relation to a deviation amount of the optical sensor in the X-axis direction. Thus, it is understood from the above that when an emission position of a light is deviated from a reference of the optical sensor, an output value of a regular reflection light receiving element more decreases when the light is emitted onto the curvature than when it is emitted onto the flat surface.

Further, it is also understood that when the radius of curvature increases and the emission position of the optical sensor deviates from the reference, the output value of the regular reflection light receiving element significantly decreases.

In this way, when the optical sensor 69 is arranged facing a section of the intermediate transfer belt 6 backed up by the driving roller 56, and the light emission position of the optical sensor 69 deviates due to the variation in the print substrate 314, the output value of the regular reflection light receiving element decreases. Consequently, the input current value Ifsg increases and is likely out of the prescribed range.

Then, according to one embodiment of the present invention, a mounting surface where the optical elements 311 to 313 are mounted is used as a reference for positioning the optical sensor 69 in relation to the apparatus. Specifically, the optical sensor 69 is attached with its mounting surface contacting the supporting member as described below with reference to FIG. 16.

Figure 5:
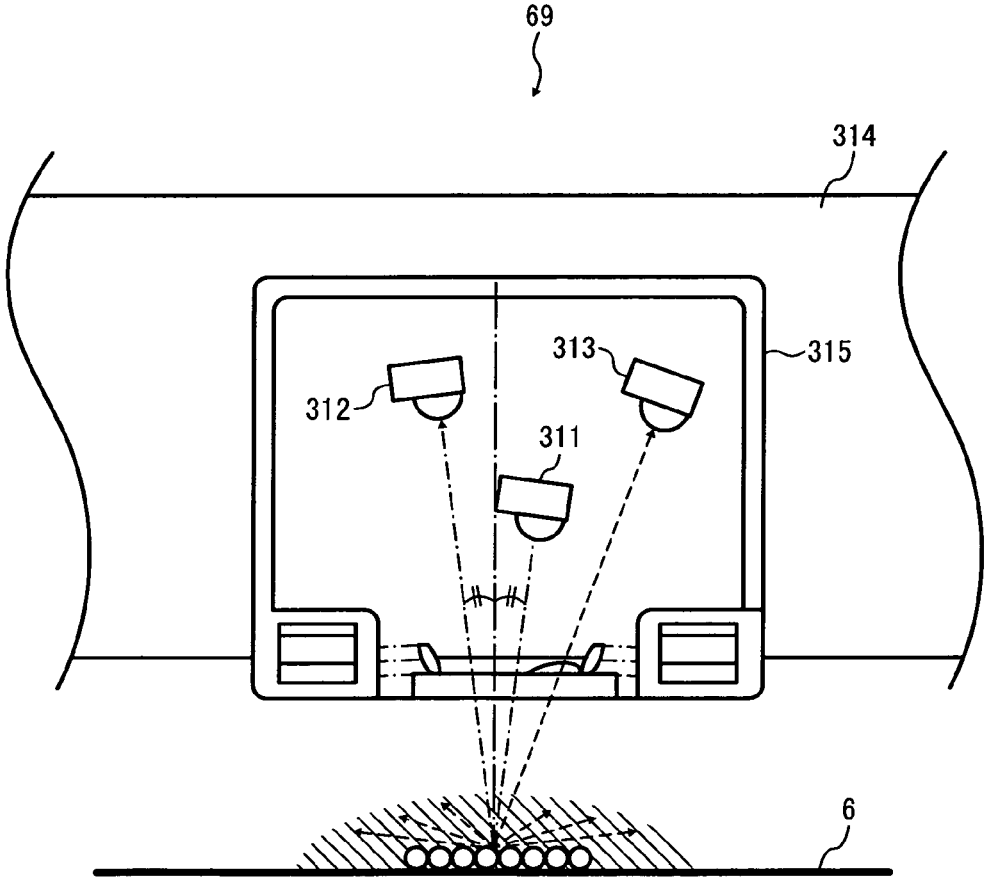
FIG. 5 schematically illustrates an exemplary optical sensor.

As shown, a supporting member 140 and am optical sensor 69 are described, and there is arranged a detection section 69*c* of FIG. 5 at a center of the print substrate 314 to detect a toner attraction amount. In the vicinity of both ends of the print substrate 314, there are provided a rear detection section 69*r* and a front detection section 69*f* to detect position deviation. Since these detection sections 69*r* and 69*f* are expected only to detect presence and absence of a positional deviation of detection use toner patches formed on the intermediate transfer belt, they only employ regular reflection light receiving elements as light receiving elements. Further, the above-mentioned correction of the optical sensor is not needed, because a problem does not occur even if a relatively large amount of current is inputted to the light emitting element 311 as different from the central detection section 96*c*.

Figure 17A:
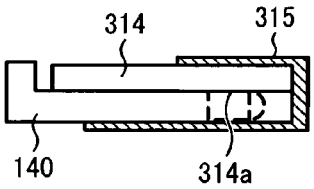
FIGS. 17A and 17B are cross sectional views collectively illustrating the optical sensor when attached to the supporter.
Figure 17B:
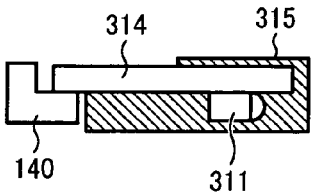

The optical sensor is attached to the supporting member 140 as shown in FIGS. 17A and 17B, wherein the former illustrates a cross section between the central and rear detection sections 69*c* and 69*r*, and the latter illustrates a cross section where the central detection section 69*c* is arranged. Specifically, the optical sensor 69 utilizes the mounting surface of the print substrate 314, where the light emitting element and light receiving elements 311 to 313 are mounted, as a reference surface for positioning of it own in relation to the apparatus body.

Figure 16:
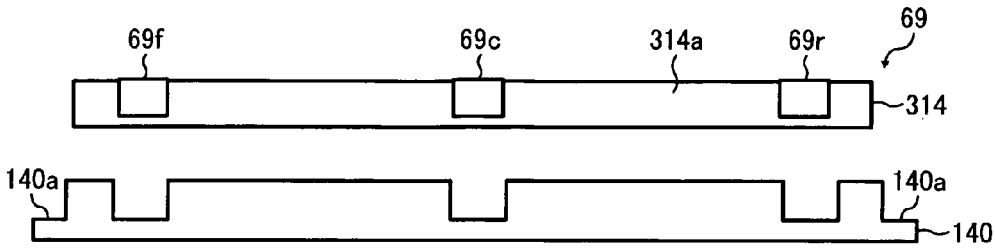
FIG. 16 is a front view illustrating an exemplary supporter and an optical sensor.

Thus, the optical sensor 69 is positioned in relation to the apparatus body with its mounting surface 314*a* contacting the support member 140 as shown in FIG. 16. Then, the optical sensor 69 is screwed to the supporting member 140.

Further, there are provided casings on the mounting surfaces to cover the light emitting element and the light receiving element in each of the detection sections. Thus, prescribed sections of the supporting member 140 corresponding to the casings of respective detection sections are hollowed out as shown in FIG. 16. Consequently, the casings of the respective detection sections do not contact the supporting member 140 while the mounting surface 314*a* of the print substrate 314 contacts the supporting member 140 without a gap therebetween as shown in FIG. 17A. The supporting member 140 is longer than the print substrate 314 with protruding sections at both ends from the print substrate 314. The protruding sections serve collision sections 140*a* where collision pins provided in a transfer unit 50 collide as mentioned later in detail.

Further, there are additionally mounted to the print substrate 314 a circuit element, such as a resistance, an operation amplifier, etc., beside the optical elements of the light emitting element and light receiving element. Accordingly, when these elements are also arranged on the mounting surface of the print substrate, the supporting member 140 needs to be correspondingly hollowed out. However, when a hollowing out processing is inaccurate, the supporting member 140 contacts the circuit element and the optical sensor 69 cannot be attached to the supporting member 140 for the safety. Further, when too many sections are hollowed out, rigidity of the supporting member 140 becomes insufficient and is readily deformed. As a result, a positional deviation of the optical sensor 69 likely occurs. When the supporting member 140 is made of metal, such as a steel plate, etc., and contacts electrodes included in the circuit elements, short circuit possibly occurs. Thus, these circuit elements need to be covered with an insulation sheet, such as a transparent film, etc., thereby increasing a cost. To resolve such a problem, the circuit elements other than the optical elements are preferably mounted on an opposite surface to the mounting surface of the print substrate 314.

Figure 18:
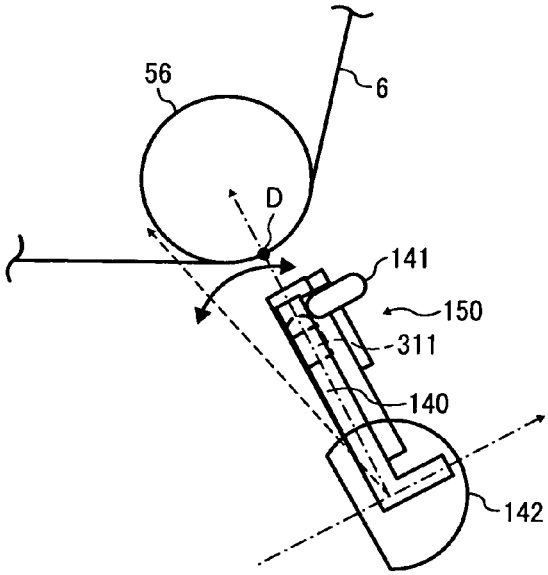
FIG. 18 schematically illustrates an exemplary configuration of a peripheral of the optical sensor attached to an apparatus body.

Now, an exemplary configuration of peripherals of the optical sensor 69 is described with reference to FIG. 18. As shown, the supporting member 140 to which the optical sensor 69 is screwed is secured to a holder 142 that is freely swingably attached to the apparatus body. The transfer unit 50 is detachably attached to the apparatus body. Thus, when the transfer unit 50 is detachably attached to the apparatus body, a position of the transfer unit sometimes varies in relation to the apparatus body before or after the detachable attachment. When the position of the transfer unit 50 varies before or after the detachable attachment in this way, an emission position of a light of the optical sensor 69 also varies as a result, likely resulting in decreasing in a regular reflection light output. Then, to avoid such a problem, a pair of collision pins 141 is provided at front and rear ends of the transfer unit 50, respectively, to collide with the pair of collision sections 140*a* arranged at both ends of the supporting member 140 as shown in FIG. 16. Consequently, the supporting member 140 is pushed by the collision pins 141 swinging the holder 142. Owing to this, the optical sensor 69 is positioned in relation to the transfer unit 50 with its optical axis passing through a center of the driving roller 15.

Figure 19A:
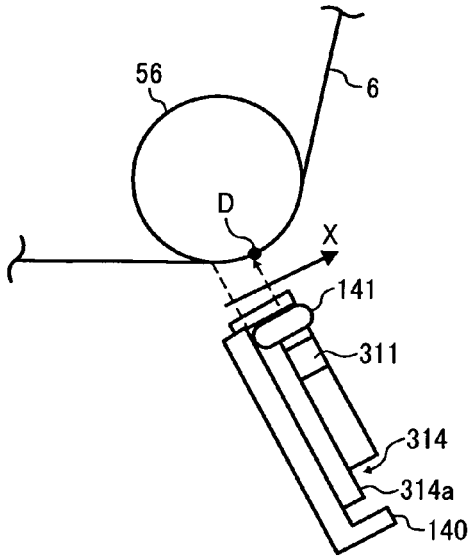
FIGS. 19A and 19B show a configuration in which a light emission position deviates due to a variation in a thickness of a substrate.
Figure 19B:
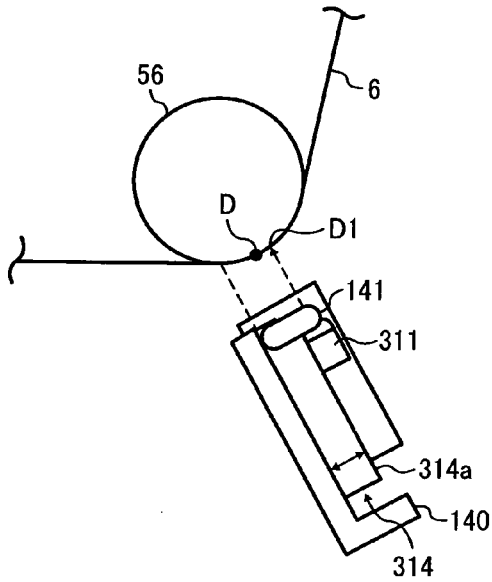
Figure 20A:
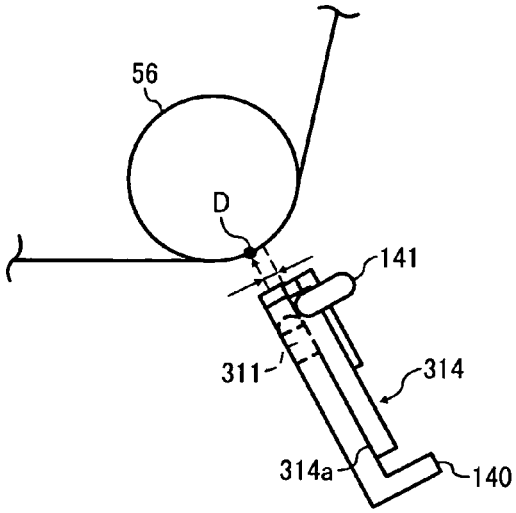
FIGS. 20A and 20B collectively illustrate a condition where the mission position does not deviate even if the thickness of the substrate fluctuates according to one embodiment of the present invention.

Now, a relation between positional deviation of a light and an output voltage of a detector is described with reference to FIGS. 19A and 19B, wherein a conventional configuration is collectively illustrated in that the opposite surface to the mounting surface 314*a* of the print substrate 314 serves as a positioning reference and contacts the supporting member 140, and FIGS. 20A and 20B, wherein an exemplary configuration of this embodiment is collectively illustrated in that the mounting surface 314*a* of the print substrate 314 serves as a positioning reference and contacts the supporting member 140. As shown in FIGS. 19A and 20A, a thickness of the substrate is a preferable target level as expected. However, FIGS. 19B and 20B each illustrates when the substrate is thicker than the target level. When the thickness of the print substrate 314 is an expected preferable level, an optical axis of the light emitting element 311 is directed to a center of the driving roller 56, and accordingly the light emitting element 311 can emit a light to a reference emission position D on the intermediate transfer belt 56.

Figure 25:
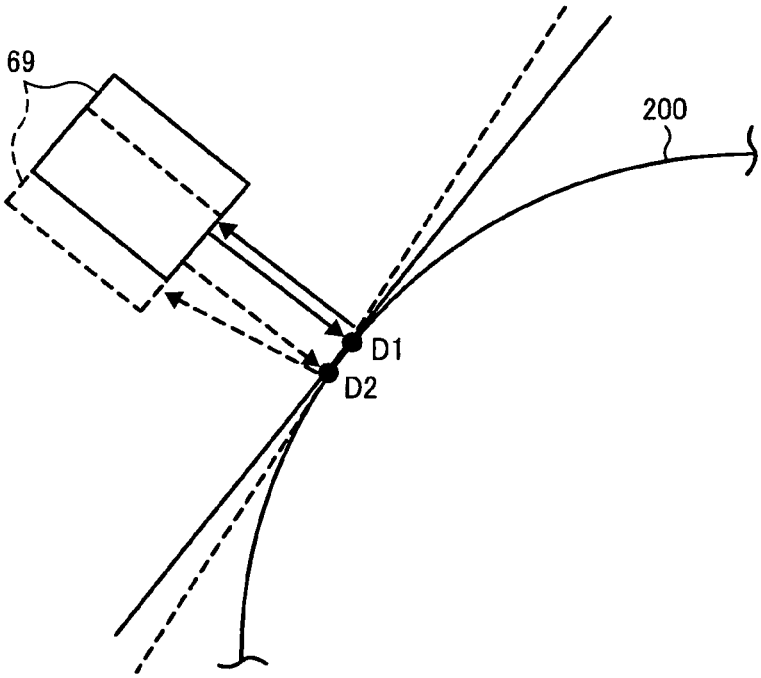
FIG. 25 illustrates an exemplary condition where an output of the regular reflection light receiving element decreases due to deviation of attachment of the optical sensor to the apparatus body in a surface movement direction of a detection object.

When the print substrate 314 is thicker than the target level in the conventional configuration, the optical axis of the light emitting element 311 deviates by an amount of a thickness fluctuation value of the print substrate 314, so that the light of the light emitting element 311 cannot be emitted toward the reference light emission position D on the intermediate transfer belt 56. As a result, a direction of the regular reflection light changes, an intensity of a light inputted to the light receiving element decreases as shown in FIG. 25, thereby decreasing an output voltage.

Figure 20B:
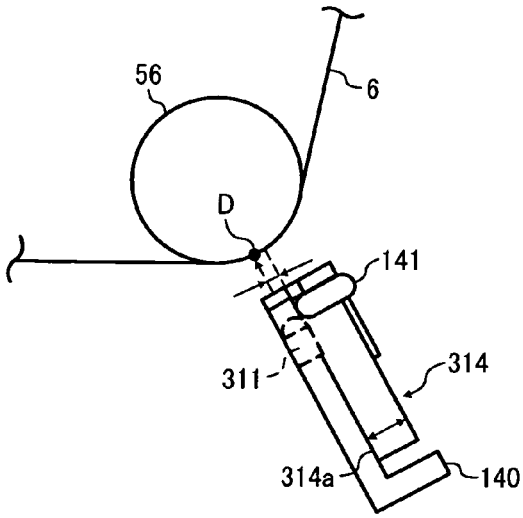

However, according to one embodiment of the present invention, even when the print substrate 314 is thicker than the target level, the optical axis of the light emitting element 311 can be directed to the center of the driving roller 56, and accordingly the light of the light emitting element 311 is emitted toward the reference emission position D on the intermediate transfer belt 56 as shown in FIG. 20B.

As mentioned heretofore, by regarding the mounting surface 314*a* of the print substrate 314 as a positioning reference and mounting the optical sensor with the mounting surface 314*a* contacting the supporting member 140, the light emitting element 311 can emit a light to the reference emission position D even when a thickness of the print substrate 314 varies or fluctuate per it. Accordingly, decreasing of an output of the regular reflection light receiving element 312 can be suppressed even when the optical sensor 69 is attached to the supporting member 140. As a result, increasing of the input current value Ifsg can be suppressed in the initial usage stage. Further, an allowance needed until the upper limit (of the input current) can be expanded even if the input current value Ifsg increases as time elapses. Further, since a toner attraction amount can be accurately calculated, image density control is highly precisely executed. Yet further, even with variation in a thickness of the substrate (per it), the light emission position does not deviate from the reference emission position D. Accordingly, by checking an output after an optical sensor is attached to a supporting member, a number of optical sensors requiring an input current Ifsg without the prescribed range can be decreased, thereby capable of improving a yielding percentage.

Figure 21:
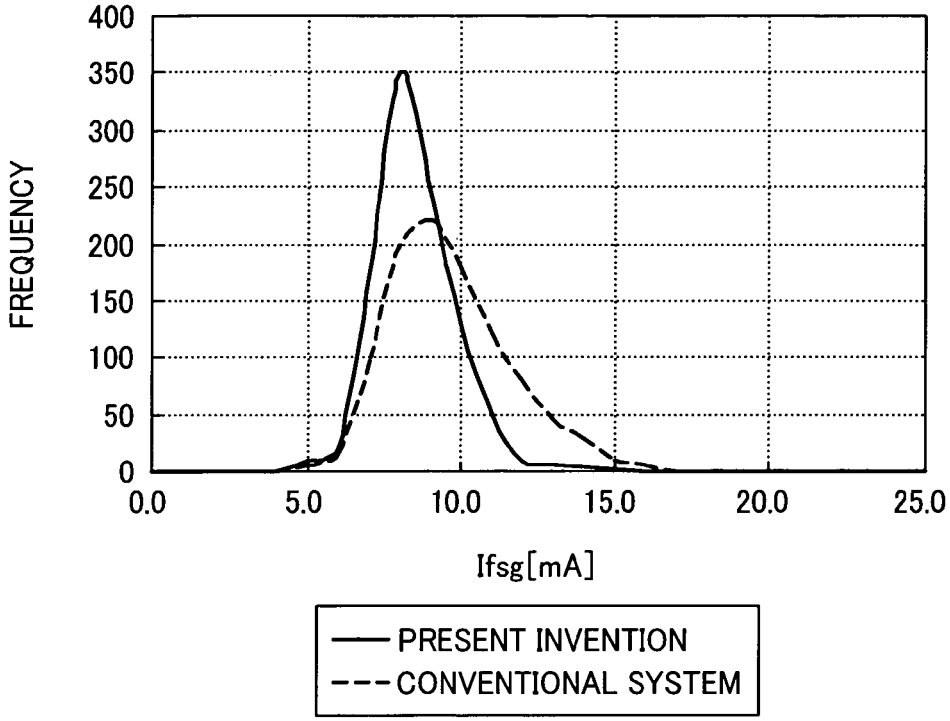
FIG. 21 illustrates an exemplary relation between normalization distributions of the input currents before and after the optical sensor is corrected in the conventional system.

Now, exemplary normal distributions of input current values Ifsg obtained by correcting one thousand of optical sensors in this embodiment of a system and in conventional system are described with reference to FIG. 21, wherein an opposite surface to a mounting surface 314*a* of a print substrate 314 serves as a positioning reference contacting the supporting member 140 in the conventional system, while a mounting surface 314*a* of a print substrate 314 serves as a positioning reference and contacts the supporting member 140 in this embodiment of the system. As understood from FIG. 21, the normal distribution of this embodiment is narrower than that of the conventional one, and a peak current of this embodiment is lower than that of the conventional one. That is, due to influence of the variation in the thickness of the substrate (per it), the emission position of the light from the optical sensor deviates and the input current value Ifsg increases in the conventional system.

Now, exemplary results of correction of an optical sensor executed both in this system and a conventional system by using a print substrate thicker than a target level by +0.2 mm are described below. An input current value Ifsg of a light emitting element 311 after correction of an optical sensor 69 is 10 mA in this system in which positioning is executed by a mounting surface 314*a* of the print substrate 314. Whereas an input current value Ifsg of a light emitting element 311 after correction of an optical sensor 69 is 15 mA in the conventional system in which positioning is executed by an opposite surface to a mounting surface 314*a* of the print substrate 314. In this way, the input current value Ifsg can be suppressed in an initial usage stage. Further, when it is estimated that the input current value Ifsg becomes twice as high from the initial stage after usage of a prescribed time period due to deterioration of gloss of a belt and toner stein on a sensor detection surface, it amounts to a value (10×2=20 mA) in this embodiment, and a value (15×2=30 mA) in the conventional example. Since the upper limit of the input current value Ifsg is 30 mA, a toner attraction amount is impossible to be accurately detected in the conventional system.

By contrast, since the input current value Ifsg is initially suppressed, a prescribed allowance needed when the Input current value Ifsg increases as time elapses can be secured.

Figure 22:
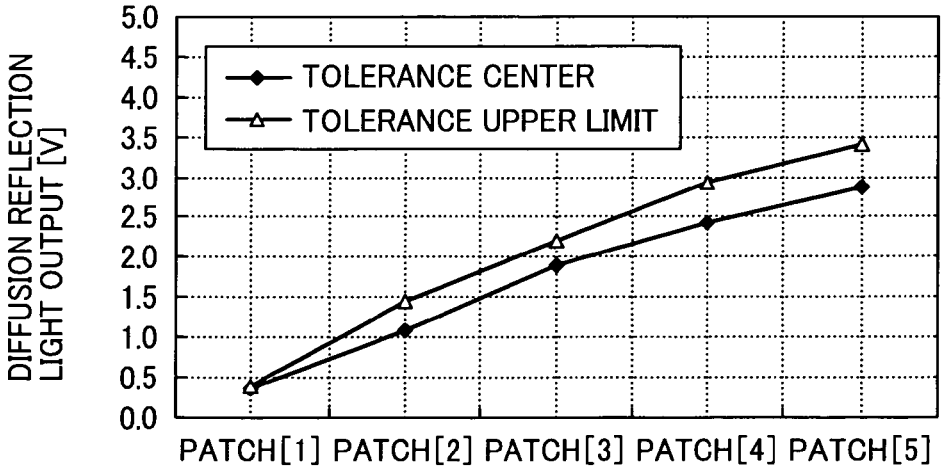
FIG. 22 illustrates exemplary output values of a diffusion reflection light receiving element when toner patches are detected on different conditions according to one embodiment of the present invention.

Now, exemplary output values of a diffusion reflection light receiving element obtained when toner patches are detected according to one embodiment of the present invention is described with reference to FIG. 22. Black dots plotted in the drawing represent output values of the diffusion reflection light receiving element 313 obtained when a central value of the prescreened range of the input current value Ifsg flows through an optical sensor 69 before attachment to a supporting member 140 according to output checking thereof. Whereas hollow out triangles plotted in the drawing represent output values of the diffusion reflection light receiving element 313 obtained when the upper limit of the prescreened range of the input current value Ifsg flows through an optical sensor 69 before attachment to a supporting member 140 according to output checking thereof.

As understood therefrom, since the light emission position does not deviate owing to the variation in the thickness, the input current value Ifsg does not largely increase avoiding the diffusion reflection light from sticking to the upper limit. Accordingly, an attraction amount of toner can be accurately calculated, and image density control can be stable.

Figure 23:
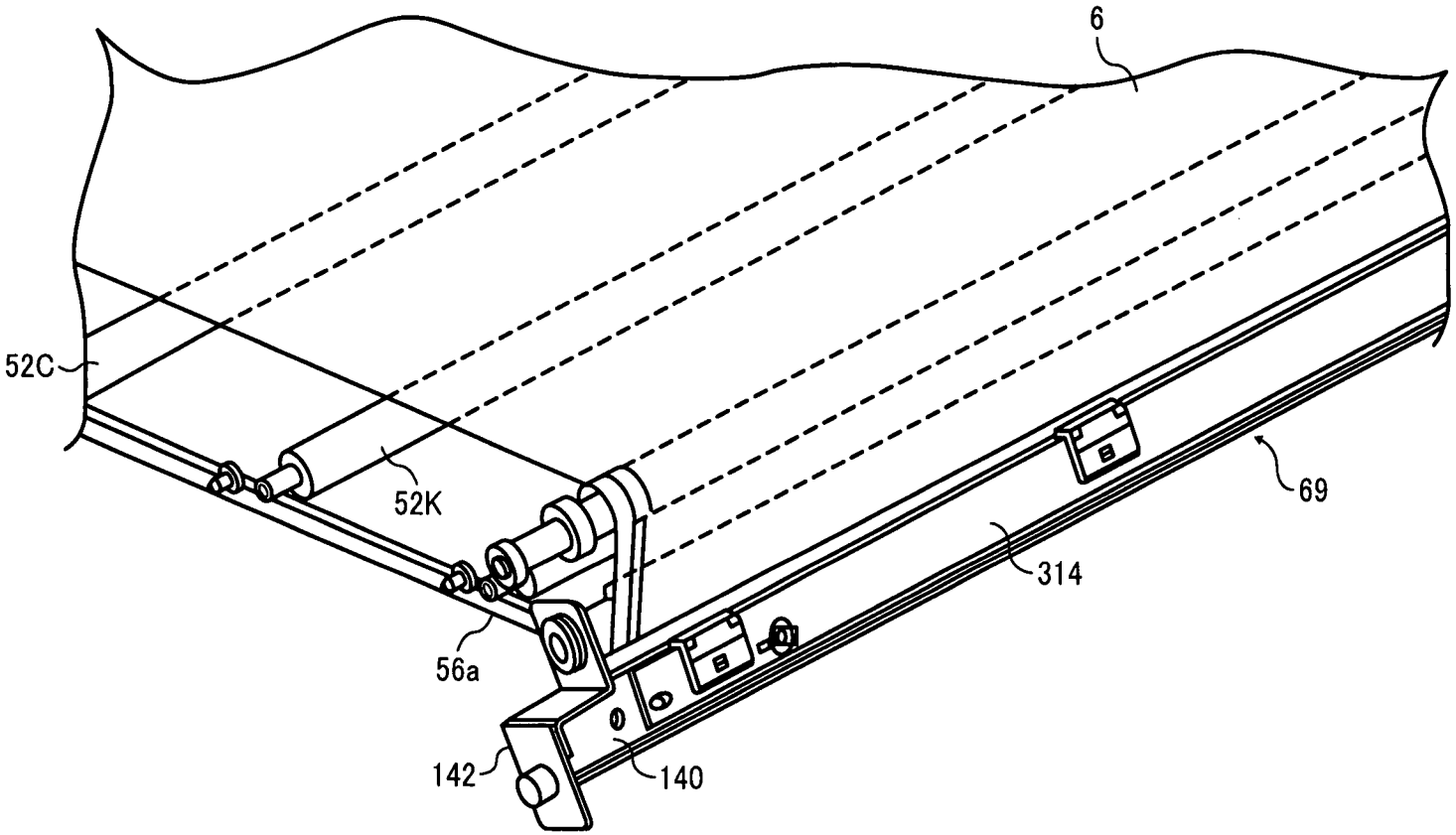
FIG. 23 illustrates exemplary peripherals of a driving roller attached to a transfer unit of a first modified printer of the present invention.

Now, first and second modifications of the printer are described with reference to FIGS. 23 and 24, respectively.

The printer of the first modification includes the optical sensor 69 in the transfer unit 50. The both ends of the supporting member 140 are secured to the holder 142 as shown. The holder 142 is attached to a peripheral surface of a bearing member 56*a* that supports a shaft of the driving roller 56 of the transfer unit 50. Then, the optical axis is positioned to coincide with a center of the driving roller 56. In this way, since the optical sensor 69 is arranged on the transfer unit 50, a light emission position does not deviate before and after attachment of the transfer unit 50.

In the second modification, a bending process is applied to the supporting member 140 to concave prescribed sections thereof in a separating direction therefrom, which face the circuit elements 316 and the casings for the detection sections 69*r*, 69*c*, and 69*f* mounted on the mounting surface 314*a* of the print substrate 314. With such concaves on the supporting member 140, rigidity thereof increases avoiding the circuit elements 316 and detection sections 69*r*, 69*c* and 69*f* from contacting the casing. Accordingly, since the rigidity does not decrease even if the circ elements 361 or the like are mounted on the mounting surface of the print substrate 314*a*, mounting of those can be safely achieved. Further, labor effectiveness can be improved in comparison with a system where elements are mounted on both surfaces of the print substrate 314. Because, the above-mentioned both side mounting needs a reversing step for reversing the substrate after attachment of the optical elements on one side surface and a further mounting step for the circuit elements onto the other side surface. Specifically, that takes a longer time period than mounting those on the same side surface.

Further, since a surface that connects a section of the supporting member 140, which contacts the mounting surface 314*a* of the print substrate 314, to the concave section thereof is perpendicular to the mounting surface 314*a*, an electrode arranged on a surface facing the mounting surface 314*a* of the circuit element 316 does not contact the supporting member 140?. Thus, due to no chance of short circuit, an insulation sheet for insulation is not needed reducing cost.

Figure 24:
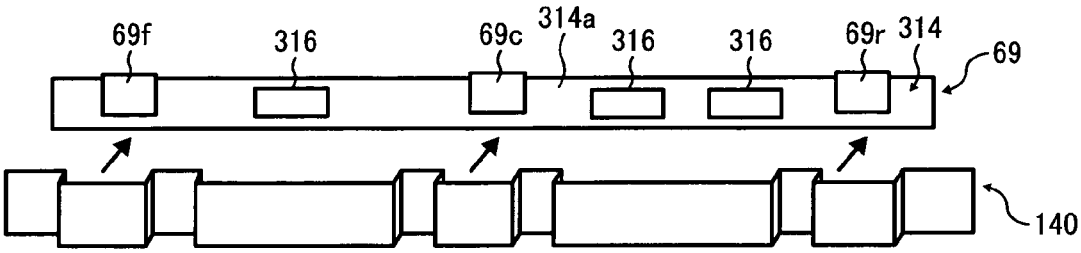
FIG. 24 schematically illustrates an exemplary configuration of a second modified printer of the present invention.

The supporting member can be shaped as shown in FIG. 24 even when the circuit element is mounted on the opposite surface to the mounting surface.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An optical sensor to mountable in an apparatus, said optical sensor comprising:

a substrate;

a light emitting element mounted on a first surface of the substrate, said light emitting element configured to emit light onto a detection object in rays parallel to the substrate; and a light receiving element mounted on the first surface of the substrate, said light receiving element configured to receive a regular reflection light reflected by the detection object, the first surface serving as a positioning reference for positioning the optical sensor on a supporting member for mounting the optical sensor in the apparatus, the supporting member being configured such that the light receiving element and the light emitting element are embedded within the supporting member, the first surface of the substrate being in contact with the supporting member.

2. The optical sensor as claimed in claim 1, wherein parts other than the light emitting and light receiving elements are mounted on a surface other than the first surface of the substrate.

3. An image forming apparatus comprising:

an image bearer having a surface configured to cause a regular reflection of light;

a toner image formation device configured to form a toner image on the image bearer;

the optical sensor as claimed in claim 1; and an image density controller configured to control image density based on a detection result of the optical sensor.

4. The image forming apparatus as claimed in claim 3, wherein a section of said supporting member facing the light emitting and light receiving elements mounted on the first surface of the substrate is concaved so as not to contact the parts upon the first surface of the substrate tightly contacting the supporting member.

5. The image forming apparatus as claimed in claim 3, wherein said optical sensor is disposed facing a curved surface of the detection object.

6. The image forming apparatus as claimed in claim 5, wherein said image bearer is a belt stretched around at least two stretching rollers, wherein said optical sensor is disposed facing one of the at least two stretching rollers.

7. The image forming apparatus as claimed in claim 6, wherein said optical sensor is attached to the supporting member with an extension of an optical axis of its light passing through a rotational center of one of the at least two stretching rollers.

8. The optical sensor of claim 1, wherein the light emitting element is mounted on the first surface of the substrate such that the light emitting element emits a maximum intensity of light parallel to the first surface.

9. The image forming apparatus of claim 3, wherein the light emitting element is mounted on the first surface of the substrate such that the light emitting element emits a maximum intensity of light parallel to the first surface.

10. The image forming apparatus of claim 3, wherein the first surface of the substrate is in direct contact with the supporting member.

11. An image forming apparatus comprising:

an image bearer;

a toner image formation device configured to form a toner image on the image bearer;

an optical sensor including a substrate, a light emitting element configured to emit light onto the image bearer and the toner image, a light receiving element mounted on a first surface of the substrate, said light receiving element configured to receive a regular reflection light reflected by the image bearer and the toner image, and a supporting member attached to the first surface of the substrate to support the optical sensor such that the light emitting element emits light at a same point on the image bearer irrespective of a change in a thickness of the substrate; and an image density controller configured to control image density based on a detection result of the optical sensor.

12. The image forming apparatus as claimed in claim 11, wherein a section of said optical sensor supporting member facing the light emitting element and the light receiving elements mounted on the first surface of the substrate, is concaved so as not to contact the light emitting element and the light receiving element upon the first surface of the substrate tightly contacting the supporting member of the optical sensor.

13. The image forming apparatus as claimed in claim 11, wherein said optical sensor is disposed so as to face a curved surface of the image bearer.

14. The image forming apparatus as claimed in claim 13, wherein said image bearer is a belt stretched around at least two stretching rollers, wherein said optical sensor is disposed facing one of the at least two stretching rollers.

15. The image forming apparatus as claimed in claim 14, wherein said optical sensor is attached to the supporting member of the optical sensor with an extension of an optical axis of its light passing through a rotational center of one of the at least two stretching rollers.

16. An image forming apparatus comprising:

an image bearer having a surface configured to cause a regular reflection of light;

a toner image formation device configured to form a toner image on the image bearer; and an optical sensor including, a substrate, a light emitting element mounted on a first surface of the substrate, said light emitting element configured to emit light onto a detection object in rays parallel to the substrate, and a light receiving element mounted on the first surface of the substrate, said light receiving element configured to receive a regular reflection light reflected by the detection object, wherein the first surface of the substrate is in contact with a supporting surface of a supporting member for mounting the optical sensor in the apparatus, the supporting member includes a pair of protruding sections disposed in contact with a pair of positioning members provided on a side of the apparatus, and the supporting surface and a flat portion of each of the pair of protruding sections are disposed parallel to each other.

17. The image forming apparatus as claimed in claim 16, wherein the supporting surface and the flat portion of each of the pair of protruding sections are formed on a same surface.

18. The image forming apparatus as claimed in claim 17, further comprising:

a detachable transfer unit attached to an apparatus body and configured to include the detection object formed on the detachable transfer unit;

wherein the pair of positioning members is fixedly positioned to a frame of the detachable transfer unit.

19. The image forming apparatus as claimed in claim 18, wherein the supporting surface is disposed perpendicular to the detection object formed on the detachable transfer unit.

20. The image forming apparatus as claimed in claim 18, wherein the pair of positioning members are a pair of pins.

21. The image forming apparatus as claimed in claim 19, wherein the supporting surface includes a rotational axis that rotates such that the supporting surface is disposed perpendicular to the detection object.

* * * * *